US005455146A

United States Patent [19]

Nishikawa et al.

[11] Patent Number: 5,455,146

[45] Date of Patent: Oct. 3, 1995

[54] METHOD FOR FORMING COLOR IMAGE

[75] Inventors: Toshihiro Nishikawa; Hiroshi Fujimoto, both of Kanagawa, Japan

[73] Assignee: Fuji Photo Film Co., Ltd., Kanagawa, Japan

[21] Appl. No.: 339,725

[22] Filed: Nov. 14, 1994

[30] Foreign Application Priority Data

Nov. 15, 1993 [JP] Japan ..... 5-285027

[51] Int. Cl.[6] ..... G03C 7/407

[52] U.S. Cl. ..... 430/383; 430/391; 430/418; 430/434; 430/436

[58] Field of Search ..... 430/383, 391, 430/418, 434, 436

[56] References Cited

U.S. PATENT DOCUMENTS 5,028,515 7/1991 Hascbe et al. ..... 430/383

*Primary Examiner*—Hoa Van Le

*Attorney, Agent, or Firm*—Sughrue, Mion, Zinn, Macpeak & Seas

[57] ABSTRACT

A method for forming a color image of a color negative photographic material which comprises subjecting a color negative photographic material to a color development processing, said color negative photographic material comprising a support having provided thereon at least one red-sensitive silver halide emulsion layer, at least one green-sensitive silver halide emulsion layer and at least one blue-sensitive silver halide emulsion layer, having a specific photographic sensitivity of 100 or more and having each of the gradients $\gamma_{AR}$, $\gamma_{AG}$ and $\gamma_{AB}$ of 0.5 to 0.9 after standard color development processing within the range of from 3 minutes to 4 minutes of the color development time, said gradients $\gamma_{AR}$, $\gamma_{AG}$ and $\gamma_{AB}$ each being a gradient of the red-sensitive, green-sensitive and blue-sensitive silver halide emulsion layers, respectively, obtained after conducting the standard color development processing, wherein each of the gradients $\gamma_{BR}$, $\gamma_{BG}$ and $\gamma_{BB}$ after the rapid color development processing within the range of from 30 seconds to 90 seconds of the color development time satisfies the following condition:

$$0.9<\gamma_{BR}/\gamma_{BG}<1.2,\ 0.9<\gamma_{BB}/\gamma_{BG}<1.2$$

wherein $\gamma_{BR}$, $\gamma_{BG}$ and $\gamma_{BB}$ each represents a gradient of the red-sensitive, green-sensitive and blue-sensitive silver halide emulsion layers, respectively, obtained after conducting the rapid color development processing.

8 Claims, 1 Drawing Sheet

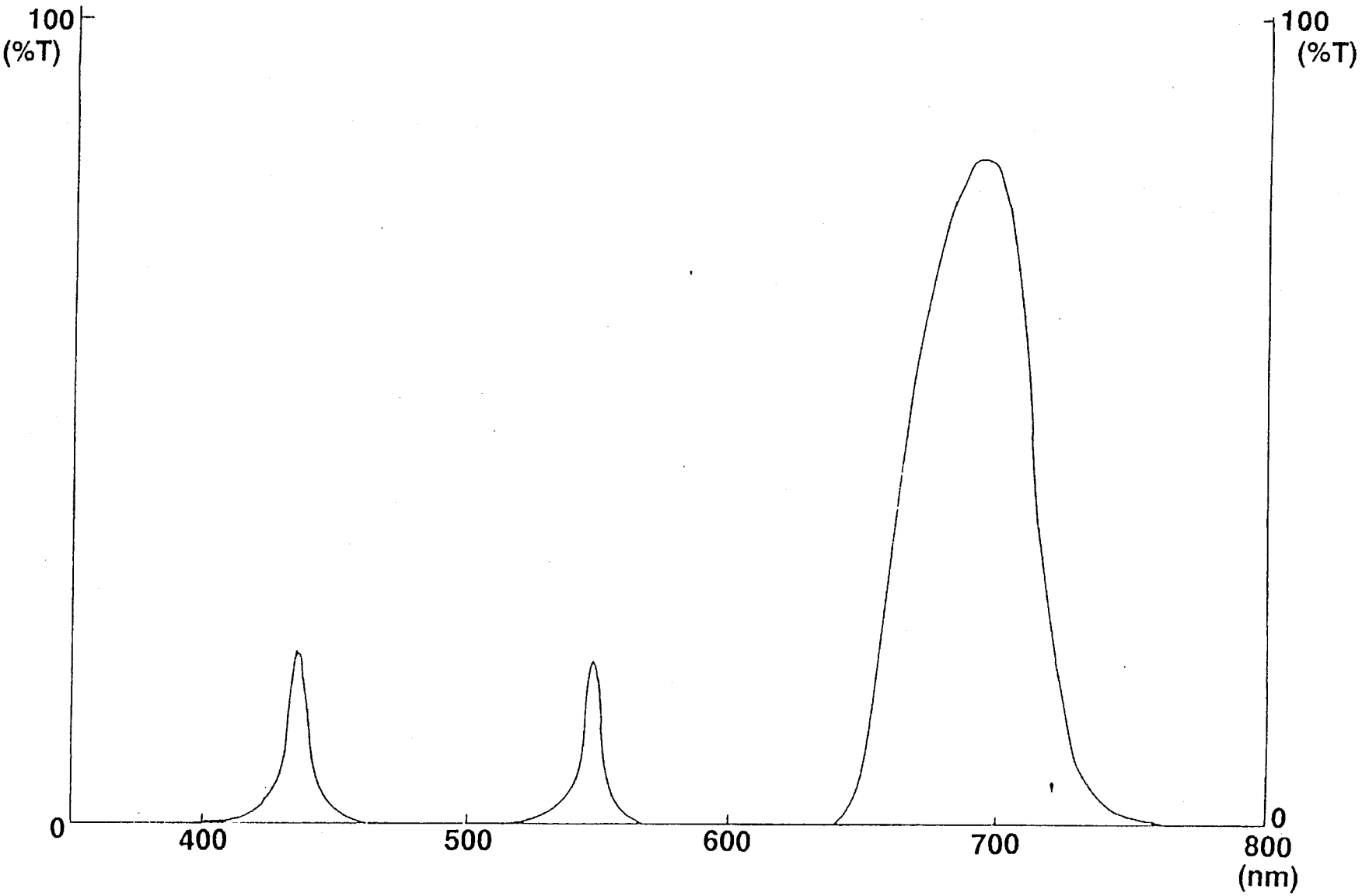
100
(%T)
0
400
500
600
700
800
(nm)
100
(%T)

METHOD FOR FORMING COLOR IMAGE

FIELD OF THE INVENTION

The present invention relates to a method for forming an image of a silver halide color light-sensitive material which is suitable to a rapid processing, and, more specifically, it relates to a method for forming an image of a silver halide color photographic material provided with adaptability to a plurality of processings which are different in the time for color development.

BACKGROUND OF THE INVENTION

There are often scenes and informations incidentally encountered in daily life which are desirable to be photographed, but the person who wishes to take photographs is not necessarily carrying always a picture-taking camera. In view of such incidental photographing chances which may often occur, there has been a strong potential demand for a picture-taking system suitable therefor.

For such a demand, a so-called lens-combined film system has been developed and is now familiar to many people. One of the important materials for the above system is a high sensitivity color negative light-sensitive material. In order to cover photographing of an object in a near distance to a far distance with a low cost fixed-focus plastic lens, a relatively dim lens having large depth of field is required and, for compensating this, a high sensitivity color negative light-sensitive material is used. For this reason, a light-sensitive material of about ISO 400 is used in the lens-combined film. Also, recently, a super high sensitivity film of ISO 800 which is conventionally belongs to a supper high sensitivity region is used for a lens-combined film and is accepted by the consumer with a good reputation.

On the other hand, another demand for photographing is that the person who takes photographs wants to instantaneously see the photographs taken. For this demand, color films for a so-called instant camera are commercially available, but such films are not widely accepted due to their high prices and unsatisfactory image quality of photographs.

For the above demand, efforts have continuously been made in the field of development processings of the color negative light-sensitive materials. The time for development processing of the color negative light-sensitive material has speeded-up by the C-41 processing introduced by Eastman Kodak in 1972 in which the wet processing time excluding a drying step is shortened up to 17 minutes and 20 seconds. Further, in the rapid processing CN-16FA which has recently been introduced by Fuji Photo Film Co., Ltd. for mini-laboratory markets, the processing time is shortened up to 8 minutes and 15 seconds. Also, the processing time of color print light-sensitive materials has markedly speeded-up by the RA-4 processing introduced by Eastman Kodak in 1986 in which the processing time including a drying step is shortened to a level of 4 minutes.

However, at present, when users ask a photo shop to print the photographed negative, it takes 20 to 30 minutes even by the processing at the most rapid-finishing shop (i.e., mini-laboratory) to make prints, and, thus, most of the customers are required to visit the photo shop twice. In order to satisfy the users needs in the color negative and color paper system applied at present so as to get the prints by visiting the photo shop once, it is necessary to greatly shorten the time required for the development processing.

However, it is very difficult to achieve the above purpose without considering the shortening of time including the color development step. Taking, for instance, a development processing of the color negative, the conventional speeding-up has mainly been achieved by shortening the time for a desilverization step, and, in the case of the processing of the above-described CN-16FA, the time required for the color development takes 40% or more of the total processing time.

As a technique for shortening the time for color development, a method for forming a color image of a color negative silver halide photographic material in which an average silver chloride content is 5 mol % or more and each of gamma R, gamma G and gamma B in the red-sensitive layer, the green-sensitive layer and blue-sensitive layer after color development is in the range of from 0.4 to 1.0, respectively, is disclosed, for example, in JP-A-3-149546 (the term "JP-A" as used herein means and "unexamined published Japanese patent application"). According to the above method, the time for the color development can be certainly shortened from 3 minutes and 15 minutes which is presently required to 1 minute and 30 seconds. However, in the above photographic material, a silver chlorobromide emulsion is used since the speeding-up is an important factor, and, therefore, the sensitivity of the photographic material is estimated as about 100 at most in terms of the ISO photosensitivity. Thus, advantages of high sensitivity and excellent graininess obtainable by using an iodobromide emulsion is sacrificed in the above photographic material. In addition to the above-described method, some methods for shortening the time for color development have been proposed, for example, in JP-A-4-93836, JP-A-4-234758, JP-A-4-234759, JP-A-4-356044 and JP-A-5-197095, but each of the proposed method uses a silver chlorobromide emulsion.

On the other hand, considering the present circumstances in which the C-41 processing of Eastman Kodak and the development processing having an interchangeability thereto have been popular worldwide, it may be very difficult to introduce any changes of the color development step including the time into the actual markets. More specifically, during an initial period of time in which a rapid processing machine is not popular in markets, introduction of a color negative photographic material which can be normally finished only with the rapid processing may be advantageous in only a very limited market.

In the present color photography, a system of taking photographs with a color negative and printing on color papers is widely accepted. The reasons therefor are that the color negative film has a very broad exposure latitude and, hence, chances of failure in photographing are very low. Differing from color reversal films and color papers, the color negative film is a photographic material which is desired in such a manner that the gradation can be reproduced in a broader exposure region. When the gradation and the gradation balance in each of the light-sensitive layers are poor, a tone reproducibility and a color reproducibility are deteriorated thereby adversely affecting the color tone upon printing.

Accordingly, it is very important to develop a technique for controlling the gradation and the gradation balance in order to obtain excellent finished quality even in either the development processing which is now broadly accepted worldwide, or the development processing for a period of time which differs from the most popular color development time.

As set forth above, a system which makes it possible to take photographs at the time as required and to obtain prints immediately after taking the photographs has not been put into a practical use, and at present the technical development for these purposes is strongly desired.

SUMMARY OF THE INVENTION

Accordingly, an object of the present invention is to provide a method for forming a color image of a high sensitivity color light-sensitive material for achieving excellent finishes in either the development processing which is at present broadly accepted in the world or the super rapid processing which is desired by the user.

More specifically, the object of the present invention is to provide a method for forming a color image of a color light-sensitive material which achieves excellent finishes when the light-sensitive material is subjected to a development processing which is different in the color development time.

As a result of extensive studies, the present inventors found that the above-described objects can be achieved by the method described hereinafter and completed the present invention:

(1) a method for forming a color image of a color negative photographic material which comprises subjecting a color negative photographic material to a color development processing, said color negative photographic material comprising a support having provided thereon at least one red-sensitive silver halide emulsion layer, at least one green-sensitive silver halide emulsion layer and at least one blue-sensitive silver halide emulsion layer, having a specific photographic sensitivity of 100 or more and having each of the gradients $\gamma_{AR}$, $\gamma_{AG}$ and $\gamma_{AB}$ of 0.5 to 0.9 after standard color development processing within the range of from 3 minutes to 4 minutes of the color development time, said gradients $\gamma_{AR}$, $\gamma_{AG}$ and $\gamma_{AB}$ each being a gradient of the red-sensitive, green-sensitive and blue-sensitive silver halide emulsion layers, respectively, obtained after conducting the standard color development processing, wherein each of the gradients $\gamma_{BR}$, $\gamma_{BG}$ and $\gamma_{BB}$ after the rapid color development processing within the range of from 30 seconds to 90 seconds of the color development time satisfies the following condition:

$$.9<\gamma_{BR}/\gamma_{BG}<1.2,\ 0.9<\gamma_{BB}/\gamma_{BG}<1.2$$

wherein $\gamma_{BR}$, $\gamma_{BG}$ and $\gamma_{BB}$ each represents a gradient of the red-sensitive, green-sensitive and blue-sensitive silver halide emulsion layers, respectively, obtained after conducting the rapid color development processing.

(2) a method for forming a color image as defined in (1) above, wherein the red-sensitive silver halide emulsion layer having a maximum sensitivity in the color photographic material contains an emulsion in which 50% or more of the total projected area is tabular silver halide grains having an aspect ratio of 2 or more, and the swelling ratio of the light-sensitive layer is 2.3 or more, and the ratio of a 2-equivalent coupler to the coupler in the red-sensitive silver halide emulsion is 50 mol % or more.

(3) a method for forming a color image as defined in (2) above, wherein the total film thickness of the light-sensitive layers is 22 μm or less.

(4) a method for forming a color image as defined in any one of (1) to (3) above, wherein the ratio of a concentration of a color developing agent in the color developing solution used in the standard color development processing and a concentration of a color developing agent in the color developing solution used in the rapid color development processing is from 1:1.5 to 1:5.

(5) a method for forming a color image as defined in (4) above, wherein the ratio of a halogen ion concentration in the color developing solution used in the standard color development processing and a halogen ion concentration in the color developing solution used in the rapid color development processing is from 1:1.5 to 1:5.

(6) a method for forming a color image as defined in any one of (1) to (5) above, wherein the development temperature of the rapid color development processing is higher than that of the standard color development processing by 2° to 15° C.

(7) a method for forming a color image as defined in (1) above, wherein the standard color development processing is carried out using a color developing solution having a color developing agent concentration of from 10 to 16 mmol/l at a development temperature of 35° to 40° C., and the rapid color development processing is carried out using a color developing solution having a color developing agent concentration of from 18 to 60 mmol/l at a development temperature of 38° to 55° C.

(8) a method for forming a color image as defined in (1) above, wherein the specific photographic sensitivity is from 320 to 3,200.

(9) a method for forming a color image as defined in (1) above, wherein the standard color development processing is a CN-16 processing of Fuji Photo Film Co., Ltd.

The present invention was achieved as a result of various studies on a technique for minimizing the variation in gradient and variation in gradation balance in the red-sensitive layer, the green-sensitive layer and the blue-sensitive layer, when a specific silver halide photographic material is subjected to color development processing for different periods of time. The layer arrangement of silver halide photographic materials for taking photographs is generally a blue-sensitive layer, a green-sensitive layer and a red-sensitive layer in order from the farthest of the support. When the silver halide photographic material is dipped in a color developing solution, the development is started in the order of the blue-sensitive layer, green-sensitive layer and red-sensitive layer, and the silver halide photographic material is designed so as to reach the desired gradient within the predetermined period of time. Accordingly, when the blue-sensitive layer, green-sensitive layer and the red-sensitive layer are developed for a shorter period of time than the predetermined time, generally the development of the blue-sensitive layer which is the farthest layer from the support proceeds, and the development of the red-sensitive layer which is the nearest layer to the support delays. The present invention is completed as a result of studies on a means for solving the delay in the development of the red-sensitive layer.

BRIEF DESCRIPTION OF THE DRAWING

FIGURE is a drawing showing a spectral transmittance of a filter for measuring a transmitted density of the color negative film after development processing.

DETAILED DESCRIPTION OF THE INVENTION

The present invention is hereinafter described in greater detail.

The silver halide color photographic material according to the present invention generally has a specific photographic sensitivity of 100 or more, preferably 320 or more, more preferably from 320 to 3,200.

The term "specific photographic sensitivity" as used herein means the sensitivity according to the international standard, ISO sensitivity, which is measured using an evaluation method comprising exposing the silver halide color photographic material to light from a light source specified by the ISO sensitivity, and within the shorter period of time after the exposure, subjecting the exposed silver halide color photographic material to a CN-16 processing recommended as a standard processing for a color negative film by Fuji Photo Film Co., Ltd. to obtain a color image. The specific photographic sensitivity is described in detail in JP-A-63-226650, lower right column of page (3) to upper left column of page (6). The reason for using the evaluation method different from the ISO sensitivity is that, in the ISO sensitivity, the photographic material is subjected to the development processing on the 5th day after exposure, and the development processing applied is in accordance with the development processing indicated in each of the photosensitive materials.

On the other hand, the specific photographic sensitivity of the present invention is evaluated by a specific development processing in a relatively short period of time, i.e., within the range of from 0.5 to 6 hours, and therefore the CN-16 processing of Fuji Photo Film Co., Ltd. is applied for the development processing.

The photographic material of the present invention may comprise a support having provided thereon at least one blue-sensitive silver halide emulsion layer, at least one, green-sensitive silver halide emulsion layer and at least one red-sensitive silver halide emulsion layer, and is not limited as to the number of silver halide emulsion layers and light-insensitive layers. A typical example of the photographic material is a silver halide color photographic material which comprises a support having provided thereon at least two color light-sensitive layers comprising a plurality of silver halide emulsion layers having substantially the same color sensitivity but different light sensitivities on a support, wherein the light-sensitive layer is a unit light-sensitive layer having the color sensitivity to any of the blue light, green light and red light. In a multi-layer silver halide color photographic material, a unit light-sensitive layer is arranged in the order of the red-sensitive layer, green-sensitive layer and blue-sensitive layer from the side of the support. The whole of the hydrophilic colloidal layers containing these color-sensitive emulsion layers is referred to as "light-sensitive layer".

A preferred wavelength of the maximum spectral sensitivity of each layer is, for example, from 420 to 480 nm for the blue-sensitive layer, from 520 to 580 nm for the green-sensitive layer, and from 620 to 680 nm for the red-sensitive layer.

A light-insensitive layer such as an intermediate layer may be provided between the above-described silver halide emulsion layers and for each of the uppermost layer and the lowermost layer.

The intermediate layer may contain couplers and DIR compounds as described in JP-A-61-43748, JP-A-59-113438, JP-A-59-113440, JP-A-61-20037 and JP-A-61-20038, and may also contain a color stain preventing agent which is generally used.

A plurality of silver halide emulsion layer which constitute each of the unit light-sensitive layers is preferably a two-layer structure of a high sensitivity emulsion layer and a low sensitivity emulsion layer as described in West German Patent No. 1,121,470 and British Patent No. 923,045. Generally, these layers are preferably arranged in such a manner that the sensitivities of the layers decrease toward the support, and a light-insensitive layer may be provided between the silver halide emulsion layers. Also, a low sensitivity emulsion layer may be provided on the side far from the support and a high sensitivity emulsion layer may be provided on the side near to the support as described in JP-A-57-112751, JP-A-62-200350, JP-A-62-206541 and JP-A-62-206543.

In specific embodiments thereof, the layers can be arranged in the order of a low sensitivity blue-sensitive layer (BL)/a high sensitivity blue-sensitive layer (BH)/a high sensitivity green-sensitive layer (GH)/a low sensitivity green-sensitive layer (GL)/a high sensitivity red-sensitive layer (RH)/a low sensitivity red-sensitive layer (RL); BH/BL/GL/GH/RH/RL; or BH/BL/GH/GL/RL/RH from the farthest side of the support.

As described in JP-B-49-15495 (the term "JP-B" as used herein means an examined published Japanese patent application), a layer arrangement can be such that the uppermost layer is a silver halide emulsion layer having the highest sensitivity, the middle layer is a silver halide emulsion layer having a sensitivity lower than that of the uppermost layer, and the lowermost layer is a silver halide emulsion layer having a sensitivity lower than that of the middle layer, i.e., the light sensitivity of silver halide emulsion layers becoming lower toward the support. Even when the layer structure comprises three layers each having different light sensitivities, a middle sensitivity emulsion layer, a high sensitivity emulsion layer and a low sensitivity emulsion layer can be arranged in the same color-sensitive layer in this order from the side far from the support as described in JP-A-59-202464.

Alternatively, in the above-described three-layer structure, the layer arrangement may be changed to a high sensitivity emulsion layer, a low sensitivity emulsion layer and a middle sensitivity emulsion layer; or a low sensitivity emulsion layer, a middle sensitivity emulsion layer and a high sensitivity emulsion layer in this order from the side far from the support. In the case of four or more layer structure, the arrangement of layers may be changed in the manner as described above.

In order to improve color reproducibility, a donor layer (CL) for an interlayer effect having a different spectral sensitivity distribution from the main light-sensitive layers such as BL, GL and RL is preferably provided adjacent or close to these main layers as described in U.S. Pat. Nos. 4,663,271, 4,705,744 and 4,707,436, JP-A-62-160448 and JP-A-63-89850.

As described above, various layer structures and arrangements can be selected depending upon the purpose of the light-sensitivity material.

The gradient in the standard white light source used in the present invention is determined according to JIS K 7614-1994 and JIS K 7602-1984 as follows. First, a test light-sensitive material is exposed through a wedge to a standard white light source at a exposure time of 1/100 second, for example, a light source having an energy distribution of 5500° K. of a black-body radiation when the test light-sensitive material is a daylight type light-sensitive material. After subjecting the light-sensitive material to the indicated development processing, each of the densities is measured through red, green and blue filters having absorption characteristics shown in the attached figure, and values providing the densities of fogs +0.2, 0.5, 1.0, 1.5, and 2.0 are plotted on a graph wherein the logarithm of the exposure amount is indicated on the abscissa and the density is indicated on the ordinate. These plotted points are then linearly approximated by the least squares method, and the tan θ of an angle θ to the abscissa is taken as $\gamma_R$, $\gamma_G$ and $\gamma_B$ of the light-sensitive material used.

In the present invention, the gradients after conducting the standard color development processing within the range of from 3 minutes to 4 minutes of the color development time (hereinafter "development processing A") are $\gamma_{AR}$, $\gamma_{AG}$ and $\gamma_{AB}$ and the gradients after conducting the rapid color development processing within the range of from 30 seconds to 90 seconds of the color development time (hereinafter "development processing B") are $\gamma_{BR}$, $\gamma_{BG}$ and $\gamma_{BB}$.

When a color negative photographic material having each of the gradients $\gamma_{AR}$, $\gamma_{AG}$ and $\gamma_{AB}$ of 0.5 to 0.9 is subjected to the rapid color development processing (i.e., development processing B), the present invention is characterized in that the gradients satisfy the following Condition 1:

$$.9<\gamma_{BR}/\gamma_{BG}<1.2,\ 0.9<\gamma_{BB}/\gamma_{BG}<1.2 \qquad \text{Condition 1}$$

When the above condition is not satisfied, the coloration on the prints obtained from the color negative developed by the development processing B is deteriorated, and the reproducibility of gray for good appreciation cannot be obtained.

In the present invention, it is particularly preferred that the gradients satisfy the following Condition 2:

$$.95<\gamma_{BR}/\gamma_{BG}<1.15,\ 0.95<\gamma_{BB}/\gamma_{BG}<1.15 \qquad \text{Condition 2}$$

In the present invention, it is preferred that the gradients satisfy the following Condition 3, particularly preferably the following Condition 4:

$$.9<\gamma_{AR}/\gamma_{AG}<1.2,\ 0.9<\gamma_{AB}/\gamma_{AG}<1.2 \qquad \text{Condition 3}$$

$$.95<\gamma_{AR}/\gamma_{AG}<1.15,\ 0.95<\gamma_{AB}/\gamma_{AG}<1.15 \qquad \text{Condition 4}$$

In the present invention, any of commercially available color papers for prints can be used. A preferred gradient of the color papers is about 2.7±0.1 at a color measurement density. As to the color measurement density, reference can be made to *Foundation of Photographic Engineering*, Edition of Silver Salt Photography, edited by Japan Photography Association, page 387.

In the present invention, the gradient is preferably $0.55<\gamma_{AR}, \gamma_{AG}, \gamma_{AB}, \gamma_{BR}, \gamma_{BG}, \gamma_{BB}<0.90$, more preferably $0.60<\gamma_{AR}, \gamma_{AG}, \gamma_{AB}, \gamma_{BR}, \gamma_{BG}, \gamma_{BB}<0.85$, and particularly preferably $0.65<\gamma_{AR}, \gamma_{AG}, \gamma_{AB}, \gamma_{BR}, \gamma_{BG}, \gamma_{BB}<0.80$.

In the present invention, it is preferred that the tabular silver halide emulsion is used in the maximum red-sensitive layer.

In the tabular silver halide emulsion used in the present invention, an aspect ratio refers to a ratio of the diameter and the thickness of the silver halide grains (i.e., the diameter/the thickness). The term "diameter" used herein means a diameter of a circle which has an area equivalent to the projected area of the grain when the tabular silver halide emulsion was observed under a microscope or an electron microscope. Accordingly, a silver halide grain having an aspect ratio of 2 or more means that a circle diameter of this grain is twice or more the thickness of the grain.

In the tabular silver halide emulsion used in the silver halide emulsion of the present invention, the diameter of the grain is at least twice the thickness of the grain, preferably from 3 to 20 times, more preferably from 4 to 15 times and most preferably from 5 to 10 times. Also, a proportion of the tabular silver halide grains in the projected area of the total silver halide grains is 50% or more, preferably 70% or more and particularly preferably 85% or more.

Further, the diameter of the tabular silver halide grain is from 0.02 to 20 μm, preferably from 0.3 to 10.0 μm and particularly preferably from 0.4 to 5.0 μm. The thickness of the tabular silver halide grain is preferably 0.5 μm or less. The diameter of the tabular silver halide grain as referred to herein means a diameter of a circle area equivalent to the projected area of grains, and the thickness of the grains as referred to herein means a distance between two parallel surfaces constituting the tabular silver halide grain.

In the present invention, more preferred tabular silver halide grains have a grain diameter of from 0.3 μm to 10.0 μm, a grain thickness of 0.3 μm or less and an average (diameter/thickness) ratio of from 5 to 10. The grains having the values higher than the above-described upper limits are not preferred since these grains cause problems in the photographic performance when the photographic material containing such grains is folded, hardly wound or contacted with a sharp article. A more preferred silver halide emulsion is that the grains having a grain diameter of from 0.4 to 5.0 μm and an average (diameter/thickness) ratio of 5 or more are at a proportion of 85% or more of the total projected area of the total silver halide grains.

The tabular silver halide grain used in the present invention is preferably silver bromide, silver iodobromide containing not more than 15 mol % silver iodide, or silver chloroiodobromide and silver chlorobromide containing not more than 50 mol % of silver chloride and not more than 2 mol % of silver iodide. The distribution of the composition in a mixed silver halide may be uniform or localized.

The tabular silver halide emulsion used in the present invention is described in the report by Cugnac, Chatean; Duffin, *Photographic Emulsion Chemistry* (published by Focal Press, New York, 1966), pages 66 to 72; and A. P. H. Trivelli and W. F. Smith, Ed., Phot. Journal 80 (1940), page 285, but can be easily prepared by referring to the methods disclosed in JP-A-58-113927, JP-A-58-113928 and JP-A-58-127921.

The tabular silver halide grains of the present invention can be chemically sensitized, if desired. For the chemical sensitization, for example, the method described in H. Frieser, ed., *Die Grundlagen der Photographischen Prozesse mit Silberhalogeniden* (Akademische Verlagsgesellschaft, 1968), pages 675–735 can be used.

More specifically, a chalcogen sensitization using active gelatin and a chalcogen-containing compound which is reactive with silver (for example, a thiosulfate, a thiourea, a mercapto compound, a rhodanine, a selenourea, a phosphine selenide, and phosphine telluride), a reduction sensitization using a reductive substance (for example, a stannous salt, an amine, a hydrazine derivative, formamidinesulfinic acid, a silane compound), and a noble metal sensitization using a noble metal compound (for example, a gold complex salt as well as a complex salt of a metal of the Group VIII of the Periodic Table such as Pt, Ir and Pd) can be used alone or in combination.

As embodiments of these chemical sensitization methods, the chalcogen sensitization is described in U.S. Pat. Nos. 1,574,944, 2,278,947, 2,410,689, 2,728,668 and 3,656,955, the reduction sensitization is described in U.S. Pat. Nos.

2,419,974, 2,983,609 and 4,054,458, and the noble metal sensitization is described in U.S. Pat. Nos. 2,399,083 and 2,448,060, and British Patent No. 618,061.

In particular, the tabular silver halide grains of the present invention are preferably sensitized by the gold sensitization or the chalcogen sensitization, or a combination thereof, particularly preferably by a combination of the gold sensitization, a sulfur sensitization and a selenium sensitization.

The tabular silver halide grains of the present invention can be subjected to a spectral sensitization with a methine dye or other compounds, if desired. Also, the tabular silver halide grains of the present invention are characterized by high spectral speed in addition to the improved sharpness. Examples of the dyes which can be used include cyanine dyes, merocyanine dyes, complex cyanine dyes, complex merocycanine dyes, holopolar cyanine dyes, hemicyanine dyes, styryl dyes and hemioxonol dyes. Particularly useful dyes are those of cyanine dyes, merocyanine dyes and complex merocyanine dyes.

Examples of the useful sensitizing dyes include those described in German Patent No. 929,080, U.S. Pat. Nos. 2,493,748, 2,503,776, 2,519,001, 2,912,329, 3,656,959, 3,672,897 and 4,025,349, British Patent No. 1,242,588 and JP-B-44-14030.

These sensitizing dyes can be used alone or in combination thereof, and a combination of sensitizing dyes is often used particularly for the purpose of supersensitization. Typical examples thereof are disclosed in U.S. Pat. Nos. 2,688,545, 2,977,229, 3,397,060, 3,522,052, 3,527,641, 3,617,293, 3,628,964, 3,666,480, 3,672,898, 3,679,428, 3,814,609 and 4,026,707, British Patent No. 1,344,281, JP-B-43-4936, JP-B-53-12375, JP-A-52-109925 and JP-A-52-110618.

The photographic emulsions used in the present invention can contain various compounds for the purposes of preventing fog during the preparation, the storage and the photographic processings of the light-sensitive material or stabilizing the photographic performance. More specifically, various compounds which are known as an anti-foggant or a stabilizer such as azoles, for example, a benzothiazolium salt, nitroimidazoles, triazoles, benzotriazoles and benzimidazoles (in particular, a nitro- or halogen-substituted compound); heterocyclic mercapto compounds, for example, mercaptothiazoles, mercaptobenzothiazoles, mercaptobenzimidazoles, mercaptothiadiazoles, mercaptotetrazoles (in particular, 1-phenyl-5-mercaptotetrazole) and mercaptopyrimidines; the above-described heterocyclic mercapto compounds having a water-soluble group such as a carboxyl group or a sulfone group; thioketo compounds, for example, oxadolinethione; azaindenes, for example, triazaindenes, tetraazaindenes (in particular, 4-hydroxy-substituted (1,3,3a,7)tetraazaindenes); benzenethiosulfonic acids; and benzenesulfinic acids can be used. With respect to more specific examples of these compounds and the method for using these compounds, reference can be made, for example, to the specifications of U.S. Pat. Nos. 3,954,474, 3,982,947 and 4,021,248, or JP-B-52-28660.

The above-described emulsion of the present invention is preferably a monodisperse emulsion.

The monodisperse emulsion as referred to in the present invention is an emulsion having a grain diameter distribution in which a coefficient of variation regarding the grain diameter of silver halide grains is 0.25 or less. The coefficient of variation as referred to herein means a value calculated by dividing a standard deviation regarding the grain diameter by an average grain diameter. That is, when a grain diameter of each of the emulsion grains is represented by "ri" and the number thereof is represented by "ni", an average grain diameter is defined by the following formula:

$$\text{Average Grain Diameter} = \Sigma rini/\Sigma ni$$

and the standard deviation thereof is defined by the following formula:

$$\text{Standard Deviation} = \Sigma(ri - \bar{r})^2/\Sigma ni$$

$\bar{r}$: average grain diameter

The grain diameter as referred to herein is a diameter corresponding to the projected area in the case of microphotographing a silver halide emulsion by the method well known in the art (generally, by taking a photograph through an electron microscope) as described in T. H. James, et al., *The Theory of The Photographic Process,* 3rd Ed., pages 36–43, Macmillan (1966). In this case, the diameter corresponding to the projected area of the silver halide grains is defined as a diameter of the circle corresponding to the projected area of the silver halide grains as described in the above reference. Accordingly, in the case of silver halide grains having a shape other than a spherical shape (e.g., a cubic, octahedron, tetradecahedron, tabular or pebble-like shape), an average diameter "$\bar{r}$" and a deviation "S" thereof can be determined as described above.

The coefficient of variation regarding the grain diameter of the silver halide grain is 0.25 or less, preferably 0.20 or less, and more preferably 0.15 or less.

The tabular silver halide emulsion of the present invention is particularly preferably a monodisperse hexagonal tabular silver halide emulsion as disclosed in, for example, JP-A-63-151618.

The term "hexagonal tabular silver halide grain" as used herein means a grain characterized in that the shape of the (1,1,1) plane thereof is hexagonal and a ratio of adjacent edges is 2 or less. The term "ratio of adjacent edges" used herein means a ratio of the length of the edge having a maximum length forming the hexagonal shape to the length of the edge having a minimum length. In the hexagonal tabular silver halide grains of the present invention, the corner of the hexagonal grain may be slightly round as long as the hexagonal tabular silver halide emulsion has the adjacent edge ratio of 2 or less. When the corner is slightly round, the length of edge is represented by the distance between the cross points at which extended lines of the linear portions of adjacent edges are crossed. In the hexagonal tabular grain of the present invention, it is preferred that at least ½ length of each of the edges forming a hexagonal shape comprises substantially a linear line, and, in particular, more than ⅘ length of each of the edges is preferably a linear line. In the present invention, a ratio of adjacent edges is preferably from 1 to 1.5.

The hexagonal tabular silver halide emulsion of the present invention comprises a dispersion medium and the silver halide grain, and 50% or more, preferably 70% or more, and more preferably 90% or more of the total projected areas of the silver halide grains thereof is composed of the hexagonal tabular silver halide grains.

In the present invention, the halogen composition of the hexagonal tabular silver halide emulsion may be any of silver bromide, silver iodobromide, silver chlorobromide or silver chloroiodobromide, but silver bromide and silver iodobromide are preferred. In the case of silver iodobromide, the content of silver iodide is from 0 to 30 mol %, preferably from 2 to 15 mol %, and more preferably from 4 to 12 mol %. The distribution of silver iodide in the grain may be uniform in the whole grain, or the content of silver iodide may be different between the inside of the grain and the surface layer of the grain, i.e., a multilayer structure in which many layers each differing in the silver iodide content are present in the interior of the grain may be formed. However, an internal iodine type grain where the content of silver iodide on the surface of the grain is lower than that of the inner portion of the grain is preferred.

The preparation of the hexagonal tabular silver halide emulsion can be referred to U.S. Pat. No. 4,797,354.

The procedure for preparing the monodisperse hexagonal tabular silver halide emulsion can be divided into a nuclei forming step, an Ostwald ripening step and a grain growing step. During the nucleus formation, the nuclei are formed while maintaining a pBr at from 1.0 to 2.5 and using supersaturated conditions (a temperature, a gelatin concentration, an addition rates of a silver salt aqueous solution and an alkali halide aqueous solution, a pBr, an iodine ion content, a rate of rotation for stirring, a pH, an amount of a silver halide solvent, a salt concentration, etc.) so as to form nuclei having a parallel twinning plane (tabular grain nuclei) as many as possible. During the Ostwald ripening step, a temperature, a pBr, a pH, a gelatin concentration, an amount of silver halide solvent, etc. are adjusted so as to destroy the grains other than the tabular grain nuclei formed in the nucleus formation and to grow only the tabular grain nuclei to obtain nuclei having a good monodispersibility. During the grain growth, hexagonal tabular silver halide grains having the desired aspect ratio and the grain size can be obtained by adjusting a pBr and amounts of a silver ion and a halogen ion to be added. During the grain growth, addition rates of the silver ion and the halogen ion are preferably adjusted to from 30 to 100% of the crystal critical growth rate.

In the above-described emulsion of the present invention, 50% in the number of the silver halide grains preferably contains 10 more more dislocation lines per grain.

The dislocation in average grains can be observed by the direct method using a transmission type electron microscope at a low temperature as described in, for example, J. F. Hamilton, *Phot. Sci. Eng.*, 11, 57 (1967) and T. Shiozawa, *J. Soc. Phot. Sci. Japan*, 35, 213 (1972). That is, the silver halide grain which has been taken out of the emulsion with a careful attention so as not to apply a pressure under which dislocations occur in the grain is placed on a mesh for an electron microscopic observation, and the grain sample is observed under the electron microscope by the transmission method in a cooled state so as to prevent damages (e.g., print-out) by an electron beam. In this case, since the thicker the thickness of the grain sample, the more difficult the transmission of the electron beam, the grain can be observed more clearly by using rather an electron microscope of a high-pressure type (200 KV to the grain having a thickness of 0.25 μm). From the photographs of the grain obtained by the above method, the position and the number of dislocations in each grain can be observed in a direction vertical to the main plane of the grain.

The position of dislocations in the tabular grains of the present invention occurs from the distance of an x % length of from the center to the edge in the long axis direction of the tabular grain to the edge. The value "x" is preferably $10 \leqq x < 100$, more preferably $30 \leqq x < 98$, and most preferably $50 \leqq x < 95$. In this case, the shape drawn by bonding the positions at which the dislocations first occur is approximately similar to the grain shape, but is not a complete similar shape and may sometimes be deformed. Directions of the dislocation lines are from substantially the center of the tabular grain to the edge thereof, but sometimes the dislocation lines are curved.

With respect to the number of dislocations in the tabular grains of the present invention, the presence of grains containing 10 or more dislocation lines at a proportion of 50% or more in terms of the number of grains is preferred, and the presence of the same at a proportion of 80% or more in terms of the number of grains is more preferred. In particular, the presence of grains containing 20 or more dislocation lines at a proportion of 80% in terms of the number of grains is most preferred.

Further, in the tabular silver halide grains which are preferably used in the present invention in which 50% (in number) or more of the silver halide grains contain 10 or more dislocation lines per grain, a relative standard deviation of the silver iodide content (%) in each of the silver halide grains is more preferably 30% or less, further more preferably 20% or less.

The silver iodide content (%) in each of the emulsion grains can be measured by analyzing the composition of each of the grains using, for example, an X-ray micro-analyzer. The term "a relative standard deviation of the silver iodide content (%) in each of the grains" as used herein is a value obtained by dividing the standard deviation of the silver iodide content (%) upon measurement of the silver iodide content of at least 100 emulsion grains using, for example, the X-ray micro-analyzer, by an average silver iodide content (%) and multiplying the resulting value by 100. Detailed procedures for measuring the silver iodide content in each of the emulsion grains is described in, for example, EP-A-147868.

When the relative standard deviation of the silver iodide content in each of the grains is high, an optimum point of chemical sensitization of each of the grains differs from each other, and thus it is difficult to ensure the performance of each of the emulsion grains, and also a relative standard deviation between the grains in the number of dislocation lines tends to be increased.

In some cases, there is a correlation between the silver iodide content Yi (mol %) in each of the grains and the diameter Xi (micron) corresponding to the sphere in each of the grains, but, in other cases, there is not. It is desirable that there is no such a correlation.

The structure relating to the halogen composition of the tabular grains can be confirmed by, for example, a combination of the X-ray diffractiometry, the EPMA (sometimes referred to XMA) method (a method for detecting a silver halide composition by scanning a silver halide grain with an electron beam), and the ESCA (sometimes referred to XPS) method (a method for subjecting the photoelectron emitted from the grain surface upon irradiation with X-rays to a spectral analysis).

The term "surface of grain" as used herein means a region to a depth of about 50 Å from the surface. The halogen composition in such a region can be generally measured by the ESCA method. The term "inside of grain" as used herein means a region other than the above-described surface region.

The emulsion comprising tabular grains having the above-described dislocation lines can be prepared based on the method described in JP-A-63-220238 and JP-A-4-181939. Also, the silver halide emulsion of the present invention preferably has a narrow distribution of grain size, and a method for preparing the silver halide emulsion through the steps of a nucleus formation-Ostwald ripening and a grain growth as described in JP-A-l-158426 can be preferably used.

However, the silver iodide content in each of the grains in the emulsion prepared by the above method tends to be non-uniform unless the content is critically controlled.

For making the silver iodide content in each of the grains of the emulsion uniform, it is necessary to make the grain size and shape after the Ostwald ripening as uniform as possible. Further, in a growing stage, an aqueous solution of silver nitrate and an aqueous solution of an alkali halide are added by the double-jet method while keeping a pAg constantly in the range of from 6.0 to 10.0. In particular, for conducting a uniform coating, a supersaturation of the solutions is preferably as high as possible during the addition. It is desirable to conduct the addition at a relatively high super-saturation in such a manner that the growing rate of the crystals is from 30 to 100% of the crystal critical growing rate as described in, for example, U.S. Pat. No. 4,242,445.

The dislocation of the tabular grain of the present invention can be controlled by providing a specific iodine-rich phase in the inside of the grain. More specifically, the tabular grain can be obtained by first preparing a substrate grain, providing an iodine-rich phase thereon, and covering the outside thereof with a phase having an iodine content ratio lower than that of the iodine-rich phase. In this case, it is important to appropriately select conditions for forming the above-described iodine-rich phase in order to make the silver iodide content in each of the grains uniform.

The inside iodine-rich phase means a silver halide solid solution containing iodine. The silver halide in this case is preferably silver iodide, silver iodobromide and silver chloroiodobromide, more preferably silver iodide or silver iodobromide (having an iodine content of from 10 to 40 mol %), and most preferably silver iodide.

It is important that the inside iodine-rich phase is not uniformly deposited on the surface of the substrate tabular grain, and rather is present in a localized manner. This localization may be in any place on the main surfaces, side surfaces, edges or corners of the tabular grain. Further, the inside iodine-rich phase may be selectively epitaxially coordinated to such portions.

For such purposes, a method comprising adding an iodide alone, i.e., a so-called conversion method, or an epitaxial junction method as disclosed in, for example, JP-A-59-133540, JP-A-58-108526 and JP-A-59-162540 can be used. In this case, the selection of the following conditions is effective for obtaining uniform silver iodide content in each of the grains. That is, pAg at the addition of an iodide is preferably in the range of from 8.5 to 10.5, more preferably in the range of from 9.0 to 10.5; a temperature is preferably maintained in the range of from 50° C. to 30° C.; and the iodide is preferably added in an amount of 1 mol % or more to the total silver amount over a period of from 30 seconds to 5 minutes while thoroughly stirring.

The iodine content in the substrate tabular grain is lower than that of the iodine-rich phase and preferably from 0 to 12 mol %, more preferably from 0 to 10 mol %.

The iodine content in the outside phase which covers the iodine-rich phase has an iodine content lower than that of the iodine-rich phase, and preferably from 0 to 12%, more preferably from 0 to 10 mol % and most preferably from 0 to 3 mol %.

The inside iodine-rich phase is preferably present in a circular region having, as a center, a grain center which is in the range of from 5 mol % to 80 mol % as a silver amount of the whole grain from the grain center regarding the long axis of the average grains, and is more preferably present in a circular region in the range of from 10 mol % to 70 mol %, particularly from 20 mol % to 60 mol %.

The term "a long axis direction of the grain" as used herein means a diameter direction of the tabular grain, and the term "a short axis direction of the grain" as used herein means a thickness direction of the tabular grain.

The iodine content in the inside iodine-rich phase is higher than an average iodine content in silver iodide, silver iodobromide or silver chloroiodobromide present on the surface of the grain, and preferably 5 times or more, and more preferably, 20 times or more of the iodine content in the above-described silver halide present on the surface of the grain.

Further, the amount of the silver halide which forms the inside iodine-rich phase is 50 mol %, more preferably 10 mol % or less, and particularly preferably 5 mol % or less, as Ag of the silver amount of the whole grain.

The characteristics of the silver halide grains can be controlled by co-existence of various compounds in the precipitation step of the silver halide production. Such compounds may be present initially in a reaction vessel. Also, in accordance with the conventional method, these compounds may be added together with one or more of the salts to be added. As described in U.S. Pat. Nos. 2,448,060, 2,628,167, 3,737,313 and 3,772,031, and *Research Disclosure*, Vol. 134, (June, 1975), No. 13452, characteristics of the silver halide can be controlled by co-existence of compounds such as the compounds of copper, iridium, lead, bismuth, cadmium, zinc (for example, chalcogenic compounds of sulfur, selenium and tellurium), gold and a noble metal of the Group VII of the Periodic Table in the precipitation step of the production of silver halides. As described in JP-B-58-1410 and Moisar et al., *Journal of Photographic Science*, Vol. 25, (1977), pages 19–27, the silver halide emulsion can be reduction sensitized in the inside of grains thereof in the precipitation step of the production of the emulsion.

In the tabular grains used in the present invention, silver halides having different compositions may be fused by epitaxial junction, and also, compounds other than the silver halide, for example, silver thiocyanate and lead oxide may be fused. These emulsion grains are disclosed in, for example, U.S. Pat. Nos. 4,094,684, 4,142,900 and 4,459,353, British Patent No. 2,038,792, U.S. Pat. Nos. 4,349,622, 4,395,478, 4,433,501, 4,463,087, 3,656,962 and 3,852,067, and JP-A-59-162540.

The tabular silver halide emulsion of the present invention is preferably chemically sensitized in the presence of a spectral sensitizing dye. A method for the chemical sensitization in the presence of the spectral sensitizing dye is disclosed in, for example, U.S. Pat. Nos. 4,425,426 and 4,442,201, JP-A-59-9658, JP-A-61-103149 and JP-A-61-133941. The spectral sensitizing dye used may be any spectral sensitizing dyes which are generally used for silver halide photographic materials, and such spectral sensitizing dyes are disclosed in *Research Disclosure,* No. 17643, (December, 1978), pages 23–24 and ibid No. 18716, (November, 1979), page 648, right column to page 649, right column. The spectral sensitizing dye can be used alone or in admixture of two or more dyes.

The addition of a spectral sensitizing dye may be effected at any time before initiating the chemical sensitization (during the grain formation, after grain formation or after washing with water), during the chemical sensitization and at the termination of the chemical sensitization, but preferably after the grain formation and before initiation of the chemical sensitization, or after termination of the chemical sensitization.

The amount of the spectral sensitizing dye added may be optional, but is preferably from 30 to 100%, and more preferably from 50 to 90% of a saturated absorption amount.

The emulsion of the present invention may be used alone in the light-sensitive emulsion layers, or two or more emulsions having different average grain sizes may be used together. In the case of using two or more emulsions, they may be used in different layers, but these emulsions are preferably used in an admixture in the same light-sensitive layer. Further, these two or more emulsions may comprise an emulsion having an average aspect ratio as defined in the present invention and an emulsion having an average aspect ratio outside the present invention. The use of a mixture of emulsions as above is preferred from the viewpoint of the control of gradation, the control of granulation over a low light-exposure region to a high light-exposure region, and the control of the color development dependency (the dependency on time and composition in the developing solution of a color developing agent, sodium sulfite, etc. and the pH dependency).

Further, the emulsion of the present invention is particularly preferred when a relative standard deviation in the silver iodide content between grains thereof is 20% or less, as disclosed in JP-A-60-143332 and JP-A-60-254032.

In the present invention, the term "film thickness of the emulsion layer" means a film thickness measured at 25° C. and at a moisture conditioning of 55% (for 2 days). The film thickness can be determined by a commercially available device for measuring the film thickness. The effect of the present invention becomes more significant as the sum of the thickness of the total hydrophilic colloid layers on the side having the emulsion layers decreases, but the sum of the thickness is limited by the volume of binders such as gelatin, couplers and dispersing solvents and is preferably from 14 to 22 μm, more preferably from 15 to 20 μm and particularly preferably from 16 to 18 μm.

The swelling ratio of the color photographic material of the present invention in a developing solution is preferably 2.3 or more from the standpoint of accelerating diffusion of the developing agent. The swelling ratio is more preferably from 2.4 to 4, and most preferably from 2.4 to 3. When the swelling ratio is too high, a distant for diffusion increases and the development may take a longer time, or reticulation may occur so heavy as to be unable to put the photographic material to practical use.

In the present invention, the swelling ratio in the developing solution refers to a value obtained by dividing a layer (film) thickness (the layer thickness of the photographic layers on the light-sensitive layer side relative to the support) after swelling in the developing solution by a dry layer thickness.

The measurement of the swollen layer thickness in the developing solution can be conducted by the method described in A. Green and G. I. P. Levenso, *J. Phot. Sci.*, 20, 205 (1972). That is, it can be obtained from an equilibrium value of the swollen film thickness in a developing solution maintained at a temperature of 38° C. As the developing solution, for example, that having the recipe described in Examples of the present invention can be used.

For the measurement of the swelling ratio as defined in the present invention, Developing Solution A is used.

In the present invention, the swelling ratio of light-sensitive material can be controlled by known methods as described below. For example, an amount of a gelatin hardener (or a film hardener) is controlled, a water absorption polymer as disclosed in JP-A-61-156252, JP-A-5-119417, etc. is used, a water retentive agent as disclosed in Belgian Patent No. 691,331 is used, a drying condition during preparation of light-sensitive material is changed, or a preservation condition of light-sensitive material after coating is changed.

The 2-equivalent couplers used in the red-sensitive layer of the present invention can be known couplers. More specifically, the 2-equivalent couplers of those described hereinafter in detail can be used.

The 2-equivalent coupler produces one molecule of a dye when 2 atoms of the imaged silver are produced by the color development. Generally, a 4-equivalent coupler forms one molecule of a dye when 4 silver halides are reduced, but the 2-equivalent coupler forms one molecule of dye when two silver halides are reduced. Accordingly, when the 2-equivalent coupler is used, the amount of silver halide can be one-half as compared with the amount of the 4-equivalent coupler for obtaining the same color image.

In the present invention, the color development rate of the red-sensitive layer can be increased by using such 2-equivalent couplers at a proportion of 50 mol % or more, preferably 75 mol % or more of the total couplers in the red-sensitive layer.

The 2-equivalent cyan coupler used in the present invention includes phenol type and naphthol type couplers, and preferred 2-equivalent couplers include those disclosed in U.S. Pat. Nos. 4,052,212, 4,146,396, 4,228,233, 4,296,200, 2,369,926, 2,801,171, 2,772,162, 2,895,826, 3,772,002, 3,758,308, 4,334,011 and 4,327,173, German Patent Publication (OLS) No. 3,329,729, EP-A-121365, EP-A-249453, U.S. Pat. Nos. 3,446,622, 4,333,999, 4,775,616, 4,451,559, 4,427,767, 4,690,889, 4,254,212 and 4,296,199, and JP-A-61-42658. Further, pyrazoloazole type couplers as disclosed in JP-A-64-553, JP-A-64-554, JP-A-64-555 and JP-A-64-556, and imidazole type couplers as disclosed in U.S. Pat. No. 4,818,672 can be used. Particularly preferred couplers include oxygen atom releasing type 2-equivalent naphthol type couplers as disclosed in U.S. Pat. Nos. 4,052,212, 4,146,396, 4,228,233 and 4,296,200. Particularly preferred couplers include 5-position substituted 2-equivalent naphthol type cyan couplers as disclosed in JP-A-6-102636.

The 2-equivalent cyan couplers used in the present invention can be introduced into the light-sensitive material by various conventional dispersion methods.

Examples of high boiling point solvents used for the oil droplet-in-water dispersion method are disclosed in U.S. Pat. No. 2,322,027. Specific examples of the high boiling point organic solvents having a boiling point of 175° C. or above under atmospheric pressure used for the oil droplet-in-water dispersion method include phthalic acid esters (for example, dibutyl phthalate, dicyclohexyl phthalate, di-2-ethylhexyl phthalate, decyl phthalate, bis(2,4-di-t-amylphenyl) phthalate, bis(2,4-di-t-amylphenyl) isophthalate and bis(1,1-di-ethylpropyl) phthalate), phosphoric acid or phosphonic acid esters (for example, triphenyl phosphate, tricresyl phosphate, 2-ethylhexyldiphenyl phosphate, tricyclohexyl phosphate, tri-2-ethylhexyl phosphate, tridodecyl phosphate, tributoxyethyl phosphate, trichloropropyl phosphate and di-2-ethylhexylphenylphosphonate), benzoic acid esters (for example, 2-ethylhexyl benzoate, dodecyl benzoate and 2-ethylhexyl-p-hydroxy benzoate), amides (for example, N,N-diethyldodecaneamide, N,N-diethyllaurylamide and N-tetradesylpyrrolidone), alcohols and phenols (for example, isostearyl alcohol and 2,4-di-tert-amylphenol), aliphatic carboxylic acid esters (for example, bis(2-ethylhexyl)sebacate, dioctyl azelate, glycerol tributylate, isostearyl lactate and trioctyl citrate), aniline derivatives (for example, N,N-dibutyl-2-butoxy-5-tert-octylaniline), hydrocarbons (for example, paraffin, dodecylbenzene and diisopropylnaphthalene). Also, an auxiliary solvent, an organic solvent having a boiling point of about 30° C. or above, preferably 50° C. to about 160° C. can be used, and typical examples thereof include ethyl acetate, butyl acetate, ethyl propionate, methyl ethyl ketone, cyclohexanone, 2-ethoxyethyl acetate, dimethyl formamide.

The steps and the effects of the latex dispersion method, and specific examples of latexes for impregnation are disclosed in, for example, U.S. Pat. No. 4,199,363, West German Patent Publication (OLS) Nos. 2,541,274 and 2,541,230.

The color development processing A of the present invention is described hereinafter.

The development time in the development processing A according to the present invention is from 3 minutes to 4 minutes, and the color developing solution is that described in JP-A-3-33847, from page 9, upper left column, line 6 to page 11, lower right column, line 6.

The color development time is preferably from 3 minutes to 3 minutes and 30 seconds, and more preferably from 3 minutes to 3 minutes and 15 seconds. The development temperature is from 35° to 40° C., and preferably from 36° to 39° C.

Specifically, processing agents for color negative films produced by Fuji Photo Film Co., Ltd., i.e., color developing solutions and color development replenishers of CN-16, CN-16X, CN-16Q, CN-16FA, or processing agents for color negative films produced by Eastman Kodak, i.e., color developing solutions of C-41, C-41B and C-41RA, can be preferably used.

The color developing agent in the color developing solution of the present invention can be a conventional aromatic primary amine color developing agent.

Preferred color developing agents are p-phenylenediamine derivatives, and typical examples thereof are shown below, which are not to be construed as limiting the present invention.

D-1: N,N-Diethyl-p-phenylenediamine

D-2: 2-Methyl-N,N-diethyl-p-phenylenediamine

D-3: 4-[N-Ethyl-N-(β-hydroxyethyl)amino]aniline

D-4: 2-Methyl-4-[N-ethyl-N-(β-hydroxyethyl)amino]aniline

D-5: 4-Amino-3-methyl-N-ethyl-N-[γ-(methanesulfonamido)propyl]aniline

D-6: 4-Amino-3-methyl-N-ethyl-N-[β-(methanesulfonamido)ethyl]aniline

D-7: 4-Amino-3-methyl-N-ethyl-N-methoxyethylaniline

D-8: 4-Amino-3-methyl-N-ethyl-N-(4-hydrobutyl)aniline

D-9: 4-Amino-3-methyl-N-ethyl-N-(3-hydroxypropyl)aniline

D-10: 4-Amino-3-methoxy-N,N-bis(3-hydroxypropyl)aniline

D-11: 4-Amino-3-methoxy-N,N-bis(4-hydroxybutyl)aniline

D-12: 4-Amino-3-methoxy-N-hydroxyethyl-N-(4-hydroxybutyl)aniline

In the present invention, D-4, D-8 and D-9 are preferred.

The development processing B according to the present invention is carried out for a period of from 30 seconds to 1 minute and 30 seconds, preferably from 45 seconds to 1 minute and 20 seconds. A preferred amount of the developing agent added in the development processing A is from 14 mmol to 25 mmol, and more preferably from 15 mmol to 20 mmol, per liter of the developing solution. Also, the concentration of the developing agent contained in the developing processing B is preferably 1.5 to 5 times, particularly preferably 2 to 4 times, that in the developing processing A whereby particularly the effect of the present invention can be obtained sufficiently. The processing temperature in the development processing B is preferably from 41° C. to 55° C., more preferably from 43° C. to 50° C. The processing temperature in the development processing B is preferably higher than that in the development processing A by 2° C. to 15° C.

The color developing solution of the present invention may contain a halogen ion as an anti-foggant. The concentration of a halogen ion in the developing processing B is preferably from 1.5 to 5 times that in the developing processing A. In particular, it is most preferred that the concentration of the halogen ion in the developing processing B is 1.5 to 5 times that of the developing processing A when the concentration of the developing agent contained in the developing processing B is from 1.5 to 5 times that of the developing processing A. More specifically, the concentration of the halogen ion in the development processing A is from 8 to 13 mmol per liter of the developing solution, and that in the development processing B is from 15 mmol to 58 mmol, preferably from 16 mmol to 42 mmol, more preferably from 16 mmol to 35 mmol, per liter of the developing solution. A particularly preferred halogen ion is a bromide ion and, if desired, an iodide ion or a chloride ion may be contained in the developing solution.

A total period for the developing processing in the present invention is preferably from 8 minutes to 15 minutes in the developing processing A and from 1 minutes to 5 minutes in the developing processing B on the dry-to-dry basis.

The color developing solution of the present invention may contain a compound which is capable of directly preserving the above-described aromatic primary amine color developing agent such as various hydroxylamines as disclosed in JP-A-63-5341, JP-A-63-106655 or JP-A-4-144446, hydroxamic acids disclosed in JP-A-63-43138, hydrazines and hydrazides as disclosed in JP-A-63-146041, phenols as disclosed in JP-A-63-44657 and JP-A-63-58443, α-hydroxyketones and α-aminoketone as disclosed in JP-A-63-44656, and various saccharides as disclosed in JP-A-63-36244. Also, in combination with the above-described compounds, monoamines as disclosed in JP-A-63-4235, JP-A-63-24254, JP-A-63-21647, JP-A-63-146040, JP-A-63-27841 and JP-A-63-25654, diamines as disclosed in JP-A-63-30845, JP-A-63-14640 and JP-A-63-43139, polyamines as disclosed in JP-A-63-21647, JP-A-63-26655 and JP-A-63-44655, nitroxy radicals as disclosed in JP-A-63-53551, alcohols as disclosed in JP-A-63-43140 and JP-A-63-53549, oximes as disclosed in JP-A-63-56654 and tertiary amines as disclosed in JP-A-63-239447.

The color developing solution of the present invention may also contain, if desired, other preservatives such as various metals as disclosed in JP-A-57-44148 and JP-A-57-53749, salicylic acids as disclosed in JP-A-59-180588, alkanolamines as disclosed in JP-A-54-3582, polyethyleneimines as disclosed in JP-A-56-94349 and polyhydroxy compounds as disclosed in U.S. Pat. No. 3,746,544.

Particularly preferred preservatives are hydroxylamines represented by the formula (I) of JP-A-3-144446, and particularly, the compounds having a sulfo group or a carboxyl group.

The pH value of the color developing solution of the present invention is from 9.5 to 11.0, preferably from 10.0 to 10.60. In addition, various additives as disclosed in the above JP-A-3-144446 can be used for the color developing solution of the present invention. For example, buffering agents for maintaining the pH value include carbonic acids, phosphoric acids, boric acids and hydroxybenzoic acids as disclosed in the above publication, on page (9), from upper right column, line 6 to lower left column, line 1. Examples of chelating agents include various aminopolycarboxylic acids, phosphonic acids, sulfonic acids as disclosed in the above publication, on page (9), from lower left column, line 2 to lower right column, line 18, and ethylenediaminetetraacetic acid, triethylenetetraminehexaacetic acid, 1,3-diaminopropanoltetraacetic acid, diethylenetriaminepentaacetic acid, ethylenediamine-N,N,N',N'-tetrakis(methylenephosphonic acid), and catechol-3,5-disulfonic acid are preferably used. Examples of developing accelerators include various additives as disclosed in the above publication, from page (9), lower left column, line 19 to page (10), upper right column, line 7. Examples of anti-foggants include halide ions and organic anti-foggants as disclosed in the above publication, on page (10), from upper right column, line 8 to lower left column, line 5. If necessary, various surface active agents such as alkylsulfonic acids, arylsulfonic acids, aliphatic carboxylic acids, and aromatic carboxylic acid may be added to the developing solution.

In processing the photographic material using a color developing solution of the present invention in an automatic developing machine, an area contacting the color developing solution with air (opening area) is preferably as low as possible. For example, an opening ratio which is defined as a value obtained by dividing an opening area ($cm^2$) by a volume of a developing solution ($cm^3$) is preferably 0.01 $cm^{-1}$ or less, and, more preferably 0.005 $cm^{-1}$ or less.

The color developing solutions can be reused after regeneration. The regeneration of the color developing solution refers to a process in which the exhausted developing solution is subjected to a treatment with an anion exchange resin or electrodialysis, or a reagent called a regenerant is added thereto to increase the activity of the color developing agent. The resulting regenerated color developing solution is reused. In this case, the regeneration ratio (the proportion of overflow solution in the replenisher) is preferably at least 50%, particularly preferably at least 70%. In the regeneration of the color developing solution, the overflow solution of the color developing solution is regenerated and then used as a replenisher.

In a preferred embodiment, the regeneration of the color developing solution is made by a method using an anion exchange resin. Examples of the compositions of particularly preferred anion exchange resins and the regeneration methods thereof include those described in *Diaion Manual (I)* (the 14th edition 1986) published by Mitsubishi Kasei Corporation. Among the anion exchange resins, resins having compositions described in JP-A-2-952 and JP-A-1-281152 are preferred.

A preferred silver halide contained in the photographic emulsion layers of the photographic material which can be used in the present invention is silver iodobromide, silver iodochloride or silver iodochlorobromide containing not more than about 30% of silver iodide. A particularly preferred silver halide is silver iodobromide or silver iodochlorobromide containing from about 2 mol % to about 10 mol % of silver iodide.

Silver halide grains in the emulsions for use in the present invention may be grains having a regular crystal form, such as cube, octahedron and tetradecahedron, or those having an irregular crystal form such as sphere and plate, those having a crystal defect such as twinning plane, or those having a composite of these crystal forms.

The silver halide grains may be either fine grains of about 0.2 μm or smaller in diameter or larger grains having a projected area diameter of up to about 10 μm. The emulsion may be either a monodisperse emulsion or a polydisperse emulsion.

The silver halide photographic emulsions which can be used in the present invention can be prepared by the method described in, for example, *Research Disclosure* (RD) No. 17643 (December, 1978), pp. 22–23, *I. Emulsion Preparation and Types, RD* No. 18716 (November, 1979), p. 648, *RD* No. 307105 (November, 1989), pp. 863–865, P. Glafkides, *Chimie et Physique Photographique*, Paul Montel (1967), G. F. Duffin, *Photographic Emulsion Chemistry*, Focal Press, (1966), and V. L. Zelikman et al., *Making and Coating Photographic Emulsion*, Focal Press, (1964).

In the present invention, monodisperse emulsions as described in U.S. Pat. Nos. 3,574,628 and 3,655,394, and British Patent 1,413,748 can be preferably used.

The crystal structure may be either a homogeneous structure or a heterogeneous structure composed of a core and an outer shell differing in halogen compositions, or may be a layered structure. Further, the grains may have a fused structure wherein a silver halides having a different halogen composition or a compound other than silver halides, e.g., silver thiocyanate, lead oxide, etc. is fused by an epitaxial junction. A mixture of grains having various crystal forms may also be used.

The silver halide emulsion used in the present invention may be of the surface latent image type in which latent images are mainly formed on the surface of grains, the internal latent image type in which latent images are mainly formed in the inside of grains or the type in which latent images are formed both on the surface and inside of grains. However, it is necessary that the emulsion is a negative type emulsion. If the emulsion is of the internal latent image type, it may be a core/shell type internal latent image emulsion as disclosed in JP-A-63-264740. A process for the preparation of such a core/shell type internal latent image emulsion is described in JP-A-59-133542. In this emulsion, although the thickness of the shall varies depending on the development process to be used, etc., it is preferably in the range of from 3 to 40 nm, and particularly preferably from 5 to 20 nm.

The silver halide emulsion to be used in the present invention is normally subjected to physical ripening, chemical ripening and spectral sensitization. Additives to be used in these steps are described in *Research Disclosure* Nos. 17643, 18716 and 307105, and pertinent descriptions thereof are tabulated below.

In the light-sensitive material of the present invention, two or more kinds of light-sensitive silver halide emulsions which are different in at least one of grain size, grain size distribution, halogen composition, grain shape and sensitivity may be incorporated in the same layer in an admixture as described above.

Surface-fogged silver halide grains as described in U.S. Pat. No. 4,082,553, internally-fogged silver halide grains as described in U.S. Pat. No. 4,626,498 and JP-A-59-214852, or colloidal silver may be preferably incorporated into a light-sensitive silver halide emulsion layer and/or substantially light-insensitive hydrophilic colloidal layer. The term "internally- or surface-fogged silver halide grains (emulsion)" as used herein means that silver halide grains (emulsion) which can be uniformly (non-imagewise) developed regardless of whether they are present in the exposed portion or unexposed portion on the light-sensitive material. Processes for the preparation of internally- or surface-fogged silver halide grains are described in U.S. Pat. No. 4,626,498 and JP-A-59-214852.

Silver halides forming the core of internally-fogged core/shell type silver halide grains may have the same or different halogen compositions. Internally- or surface-fogged silver halide grains may comprise any of silver chloride, silver chlorobromide, silver iodobromide and silver chloroiodobromide. The size of these fogged silver halide grains is not specifically limited, and its average grain size is preferably in the range of from 0.01 to 0.75 μm, and particularly from 0.05 to 0.6 μm. The crystal form of these grains is not specifically limited and may be regular grains. These emulsions may be polydisperse but is preferably monodisperse (at least 95% of silver halide grains in terms of weight or number of grains are those having grain diameters falling within ±40% of the average grain size).

In the present invention, light-insensitive finely divided silver halide grains are preferably used. Light-insensitive finely divided silver halide grains are silver halide grains which are not sensitive to light upon imagewise exposure for obtaining dye images so that they are not substantially developed in the development process. Preferably, these silver halide grains are not previously fogged.

These light-insensitive fine silver halide grains have a silver bromide content of from 0 to 100 mol % and may optionally contain silver chloride and/or silver iodide, preferably from 0.5 to 10 mol % of silver iodide.

These light-insensitive fine silver halide grains preferably have an average diameter of from 0.01 to 0.5 μm, more preferably from 0.02 to 0.2 μm, as calculated in terms of an average value of a diameter of the circle having the same area as the projected area of grains.

These light-insensitive fine silver halide grains can be prepared in the same manner as ordinary light-sensitive silver halide. In this case, the surface of the light-insensitive fine silver halide grains need not be chemically sensitized or spectrally sensitized. However, prior to addition of the grains to a coating solution, a known stabilizer such as a triazole, azaindene, benzothiazolium or mercapto compound or a zinc compound is preferably added to the grains. Colloidal silver can be preferably incorporated into the layer containing these fine silver halide grains.

The coating amount of silver in the light-sensitive material of the present invention is preferably 8.0 g/m$^2$ or less, more preferably 6.0 g/m$^2$ or less.

Known photographic additives which can be used in the present invention are also described in the above cited three *Research Disclosures*, and the related descriptions are shown in the following table in which the right column is indicated as "RC" and the left column is indicated as "LC".

| Kind of Additives | RD 17643 | RD 18716 | RD 307105 |
|---|---|---|---|
| 1. Chemical sensitizer | p.23 | p.648 RC | p.866 |
| 2. Sensitivity increasing agent | | p.648 RC | |
| 3. Spectral sensitizer and supersensitizer | pp.23–24 | p.648 RC–p.649 RC | pp.866–868 |
| 4. Brightening agent | p.24 | p.647 RC | p.868 |
| 5. Anti-foggant and stabilizer | pp.24–25 | p.649 RC | pp.868–870 |
| 6. Light absorbent, filter dye, and ultraviolet absorber | pp.25–26 | p.649 RC–p.650 LC | p.873 |
| 7. Stain inhibitor | p.25 RC | p.650 LC–RC | p.872 |
| 8. Dye image stabilizer | p.25 | p.650 LC | p.872 |
| 9. Hardening agent | p.26 | p.651 LC | pp.874–875 |
| 10. Binder | p.26 | p.651 LC | pp.873–874 |
| 11. Plasticizer and lubricant | p.27 | p.650 RC | p. 876 |
| 12. Coating aid and surface active agent | pp.26–27 | p.650 RC | pp.875–876 |
| 13. Antistatic agent | p.27 | p.650 RC | pp.876–877 |
| 14. Matting agent | | | pp.878–879 |

In order to inhibit deterioration in photographic properties due to formaldehyde gas, a compound capable of reacting with and solidifying formaldehyde as disclosed in U.S. Pat. Nos. 4,411,987 and 4,435,503 is preferably incorporated into the light-sensitive material.

The light-sensitive material of the present invention preferably contains a mercapto compound as disclosed in U.S. Pat. Nos. 4,740,454 and 4,788,132, JP-A-62-18539 and JP-A-1-283551.

The light-sensitive material of the present invention preferably contains a fogging agent, a development accelerator, a silver halide solvent or a compound which is capable of releasing a precursor thereof as disclosed in JP-A-1-106052 regardless of the amount of developed silver produced by the development processing.

The light-sensitive material of the present invention preferably contains a dye which has been dispersed by the method disclosed in published unexamined International Application No. W088/04794 and published unexamined International Application No. 1-502912 or a dye as disclosed in EP-A-317308, U.S. Pat. No. 4,420,555 and JP-A-1-259358.

Various color couplers can be used for the light-sensitive material of the present invention. Specific examples of the color couplers are disclosed in the patents described in the above-cited *Research Disclosure* No. 17643, VII-C to G and *Research Disclosure* No. 307105, VII-C to G.

Preferred yellow couplers include those described in U.S. Pat. Nos. 3,933,501, 4,022,620, 4,326,024, 4,401,752 and 4,248,961, JP-B-58-10739, British Patent Nos. 1,425,020 and 1,476,760, U.S. Pat. Nos. 3,973,968, 4,314,023 and 4,511,649, and EP-A-249473 from the viewpoint of decreasing the thickness of emulsion layer.

Preferred magenta couplers include 5-pyrazolone type compounds and pyrazoloazole type compounds. Particularly preferred are those described in U.S. Pat. Nos. 4,310,619 and 4,351,897, European Patent No. 73,636, U.S. Pat. Nos. 3,061,432 and 3,725,067, *Research Disclosure* No. 24220 (June, 1984), JP-A-60-33552, *Research Disclosure* No. 24230 (June, 1984), JP-A-60-43659, JP-A-61-72238, JP-A-60-35730, JP-A-55-118034, JP-A-60-185951, U.S. Pat. Nos. 4,500,630, 4,540,654 and 4,556,630, and published unexamined International Application No. WO88/04795.

4-Equivalent cyan couplers used in the present invention include phenol type and naphthol type couplers, and 4-equivalent couplers as described in U.S. Pat. Nos. 4,052,212, 4,146,396, 4,228,233, 4,296,200, 2,369,929, 2,801,171, 2,772,162, 2,895,826, 3,772,002, 3,758,308, 4,334,011 and 4,327,173, West German Patent Publication (OLS) No. 3,329,729, EP-A-121365 and EP-A-249453, U.S. Pat. Nos. 3,446,622, 4,333,999, 4,775,616, 4,451,559, 4,427,767, 4,690,889, 4,254,212 and 4,296,199, JP-A-61-42658 are preferred. Further, pyrazoloazole type couplers as disclosed in JP-A-64-553, JP-A-64-554, JP-A-64-555 and JP-A-64-556, and imidazole type couplers as disclosed in U.S. Pat, No. 4,818,672 can be used.

It is preferred that polymerized dye-forming couplers are used in the present invention in order to decrease the thickness of emulsion layer.

Typical examples of polymerized dye-forming couplers are disclosed in U.S. Pat. Nos. 3,451,820, 4,080,211, 4,367,282, 4,409,320 and 4,576,910, British Patent No. 2,102,137, and EP-A-341188.

Preferred examples of couplers whose developed dyes have an appropriately diffusible property include those described in U.S. Pat. No. 4,366,237, British Patent No. 2,125,570, European Patent No. 96,570 and West German Patent Publication (OLS) No. 3,234,533.

Preferred examples of colored couplers for correcting unnecessary absorption of the developed dyes include those described in *Research Disclosure* No. 17643, Item VII-G, *Research Disclosure* No. 307105, Item VII-G, U.S. Pat. No. 4,163,670, JP-B-57-39413, U.S. Pat. Nos. 4,004,929, and 4,138,258, British Patent No. 1,146,368. Further, couplers for correcting unnecessary absorption of developed dyes by fluorescent dye released during coupling as disclosed in U.S. Pat. No. 4,774,181 and couplers having, as an eliminable group, a dye precursor group capable of reacting with developing agents to form a dye as disclosed in U.S. Pat. No. 4,777,120 can be advantageously used.

Compounds which release a photographically useful residual group on coupling can be advantageously used in the present invention. Preferred examples of DIR couplers which release a restrainer include those described in patent specifications cited in Research Disclosure 17643, Item VII-F and RD 307105, VII-F, JP-A-57-151944, JP-A-57-154234, JP-A-60-184248, JP-A-63-37346, JP-A-63-37350, U.S. Pat. Nos. 4,248,962 and 4,782,012.

Preferred couplers which imagewise release a nucleating agent or a development accelerator during development are those disclosed in British Patent Nos. 2,097,140 and 2,131,188, JP-A-59-157638 and JP-A-59-170840. In addition, compounds of releasing a foggant, a development accelerator or a silver halide solvent by redox reaction with an oxidation product of a developing agent as disclosed in JP-A-60-107029, JP-A-60-252340, JP-A-1-44940 and JP-A-1-45687 are also preferably used.

Other compounds which can be used in the light-sensitive material of the present invention include a competing coupler as disclosed in U.S. Pat. No. 4,130,427, a polyequivalent coupler as disclosed in U.S. Pat. Nos. 4,283,472, 4,338,393 and 4,310,618, a DIR redox compound releasing coupler as disclosed in JP-A-60-185950 and JP-A-62-24252, a DIR coupler-releasing coupler, a DIR coupler-releasing redox compound or a DIR redox-releasing redox compound, a coupler which releases a color-recovering dye after release as disclosed in EP-A-173302 and EP-A-313308, a ligand-releasing coupler as disclosed in U.S. Pat. No. 4,555,477, a coupler which releases a leuco dye as disclosed in JP-A-63-75747, and a coupler which releases a fluorescent dye as disclosed in U.S. Pat. No. 4,774,181.

The couplers used in the present invention can be introduced into the light-sensitive material by various conventional dispersion methods. Specifically, the same dispersion method as those of the above-described 2-equivalent cyan couplers can be used.

To the color light-sensitive material of the present invention are preferably added various antiseptics and antifungal agents such as phenethyl alcohol, or 1,2-benzisothiazolin-3-one, n-butyl p-hydroxybenzoate, phenol, 4-chloro-3,5-dimethylphenol, 2-phenoxyethanol, and 2-(4-thiazolyl)benzimidazole as disclosed in JP-A-63-257747, JP-A-62-272248 and JP-A-1-80941.

Examples of suitable supports which can be used in the present invention are described in the above-cited *RD* No. 17643, page 28, *RD* No. 18716, page 647, right column to page 648, left column and *RD* No. 307105, page 879. Preferred supports include a triacetate support (TAC) and a polyester support.

It is preferred that at least one hydrophilic colloid layer having a thickness of 2 μm to 20 μm in total is provided on the opposite side of the light-sensitive materials (which is referred to as back layer) of the present invention to the emulsion layer side thereof. It is also preferred that the back layer contains the above-described light absorber, filter dye, ultraviolet ray absorber, antistatic agent, hardening agent, binder, plasticizer, lubricant, coating aid, surface active agent, etc. The swelling ratio of the back layer is preferably from 2.5 to 6.0.

The silver halide color photographic material of the present invention easily exhibits its effects and is efficient when it is applied to the lens-combined film unit disclosed in, for example, JP-B-2-32615 and Japanese Utility Model Publication No. Hei-3-39784.

In the present invention, the light-sensitive material processed with a processing solution having an ability of bleaching is subjected to a fixing or bleaching-fixing processing. The fixing solution or bleaching-fixing solution is preferably that disclosed in JP-A-3-33847, from page 6, lower right column, line 16 to page 8, upper left column, line 15.

The desilvalization step including the bleaching, bleaching-fixing and fixing is specifically as follows:

Bleaching-Fixing

Bleaching-Washing-Fixing

Bleaching-Bleaching-fixing

Bleaching-Washing-Bleaching-fixing

Bleaching-Bleaching-fixing-Fixing

Bleaching-fixing

The fixing agent contained in a fixing solution or a bleaching-fixing solution which can be used in the present invention includes thiosulfates such as sodium thiosulfate, ammonium thiosulfate, sodium ammonium thiosulfate, and potassium thiosulfate, thiocyanate (rhodanates) such as sodium thiocyanate, ammonium thiocyanate and potassium thiocyanate, a thiourea and a thio ether.

As a fixing agent, an amount of a thiosulfate when used alone is from about 0.3 to about 3 mols, preferably from 0.5 to 2 mols, and an amount of a thiocyanate when used alone is from about 1 to about 4 mols, per liter of a fixing solution or a bleaching-fixing solution. Generally, including the case where the agent is used in combination with other agents, the amount of the fixing agent can be from 0.3 to 5 mols, preferably from 0.5 to 3.5 mols, per liter of a fixing solution or a bleaching-fixing solution. However, when fixing agents are used in combination, the total amounts thereof can be within the above-described range.

Other than the thiocyanates, compounds which can be used in combination with the thiosulfate include a thiourea and a thio ether (for example, 3,6-dithia-1,8-octadiol).

Also, in the case of ammonium thiosulfate which is generally used as a fixing agent in the bleaching-fixing solution, it may be substituted by known other fixing agents, for example, a meso-ionic compound, a thio ether type compound, a thiourea, a large amount of iodide, or hypo.

The fixing solution or a bleaching-fixing solution may contain, as a preservative, a sulfite (for example, sodium sulfite, potassium sulfite and ammonium sulfite) and hydroxylamine, hydrazine, a bisulfite addition product of an acetoaldehyde compound (for example, acetoaldehyde sodium bisulfite). Further, the solution may contain various fluorescent brightening agents or defoaming agents or surface active agents, and organic solvents such as polyvinyl pyrrolidone and methanol, and, in particular, sulfinic acid compounds as disclosed in JP-A-60-283881 as preservatives can be desirably used.

Furthermore, it is preferred to add various aminopolycarboxylic acids and chelating agents such as organic phosphonic acids to the fixing solution and/or bleaching-fixing solution for the purpose of stabilization of the processing solution. Preferred chelating agents include 1-hydroxyethylidene-1,1-diphosphonic acid, ethylenediamine-N,N,N'N'-tetrakis(methylenephosphonic acid), nitrilotrimethylenephosphonic acid, ethylenediaminetetraacetic acid, diethylenetriaminepentaacetic acid, cyclohexanediaminetetraacetic acid, and 1,2-propylenediaminetetraacetic acid. Of these compounds, 1-hydroxyethylidene-1,1-diphosphonic acid and ethylenediaminetetraacetic acid are particularly preferred.

The fixing solution or the bleaching-fixing solution preferably has a pH of from 5 to 9, more preferably from 5.5 to 8.

The fixing solution and/or the bleaching-fixing solution preferably contains a compound having a pKa in the range of from 6.0 to 9.0 for pH adjustment or as a buffering agent. These compounds are preferably imidazole compounds.

The imidazole compounds include imidazole and derivatives thereof, and preferred substituents for imidazole include an alkyl group, an alkenyl group, an alkynyl group, an amino group, a nitro group and a halogen atom. Also, the alkyl group, the alkenyl group and the alkynyl group may be further substituted with an amino group, a nitro group or a halogen atom. The total number of carbon atoms in the substituent of imidazole is from 1 to 6, and the most preferred substituent is a methyl group.

Specific examples of the imidazole compounds include imidazole, 1-methylimidazole, 2-methylimidazole, 4-methylimidazole, 4-(2-hydroxyethyl)imidazole, 2-ethylimidazole, 2-vinylimidazole, 4-propylimidazole, 4-(2-aminoethyl)imidazole, 2,4-dimethylimidazole and 2-chloroimidazole. Of these compounds, preferred compounds are imidazole, 2-methylimidazole and 4-methylimidazole, and the most preferred compound is imidazole.

These imidazole compounds are preferably contained in the fixing solution and/or the bleaching-fixing solution in an amount of 0.01 mol/liter or more, more preferably from 0.1 to 10 mols/liter, and particularly preferably from 0.2 to 3 mols/liter.

When the processing of the present invention is carried out by using a replenishment system, the replenishment rate of the fixing solution or the bleaching-fixing solution is preferably 100 to 3,000 ml, more preferably from 400 to 1,800 ml per $m^2$ of the light-sensitive material. The replenishment of the bleaching-fixing solution may be performed by a bleaching-fixing replenisher, or the overflow solutions of the bleaching solution and fixing solution may be used as described in JP-A-61-143755 and JP-A-3-213853.

It is preferred that the processing solutions having an ability of bleaching are aerated when processing is conducted in the present invention. The aeration can be carried out by conventional means well-known in the art. For example, the aeration can be performed by blowing air into the bleaching solution or allowing air to be absorbed by the solution through an ejector.

It is preferred that air is introduced into the solution through a diffuser having fine pores when air is to be blown into the solution. Such a diffuser is widely used in aeration tanks in activated sludge process. The aeration is described in more detail in Z-121, *Using Process C-41*, the 3rd edition (1982), Bl-1 to Bl-2, published by Eastman Kodak.

In the fixing step, agitation is preferably intensified at the same time of the bleaching and bleaching-fixing, and more specifically the jet-agitation method is most preferred.

In the present invention, silver can be recovered from the fixing solutions and/or the bleaching-fixing solutions by conventional methods, and the regenerated solutions from which silver has been recovered can be reused. Silver recovering methods which can be effectively used include an electrolysis method (described in French Patent 2,299,667), a precipitation method (described in JP-A-52-73037 and German Patent No. 2331220), an ion exchange method (described in JP-A-51-17114 and German Patent No. 2548237) and a metal displacement method (described in British Patent No. 1353805). These silver recovering methods are preferred because rapid processability becomes much better when silver recovery is conducted in the tank solutions through an in-line procedure.

It is preferred that the bleaching solutions and/or the bleaching-fixing solutions are intensely agitated in the processing of the present invention. The agitating methods described in JP-A-3-33847 (page 8, upper right column, line 6 to page 8, lower left column, line 2) can be used as such. Of these methods, a jet-agitating system in which a bleaching solution is jetted to the surface of the emulsion of the light-sensitive material is preferred.

In the present invention, the total processing time of the desilverization step comprising a combination of bleaching, bleaching-fixing and fixing processings is preferably from 20 seconds to 3 minutes and, more preferably, from 30 seconds to 2 minutes. Also, the processing temperature is from 30° to 60° C., preferably from 35° to 55° C.

After the processing step using the fixing solution and/or bleaching-fixing solution, a washing step is generally conducted. After processing with the processing solutions having an ability of fixing, an expedient method of conducting a stabilization processing using a stabilizing solution without substantially conducting washing can be used.

Washing water used in the washing step and the stabilizing solution used in the stabilization step may contain various surface active agents to prevent water spots from being formed during the course of the drying of the light-sensitive material after processing. Nonionic surface active agents are preferred and alkylphenol ethylene oxide adducts are particularly preferred. Preferred examples of the alkylphenol include octylphenol, nonylphenol, dodecylphenol and dinonylphenol. A number of mols of ethylene oxide to be added in the adducts is preferably from 8 to 14. It is also preferred that silicone surface active agents having a high anti-foaming effect are used.

Washing water and the stabilizing solution may contain an antibacterial agent and an antifungal agent to inhibit the formation of scales and to prevent growth of molds in the light-sensitive material after processing. Further, it is preferred that washing water and the stabilizing solution contain various chelating agents. Preferred examples of the chelating agents include aminopolycarboxylic acids such as ethylenediaminetetraacetic acid and diethylenetriaminepentaacetic acid, organic phosphonic acid such as 1-hydroxyethylidene-1,1-diphosphonic acid and diethylenetriamine-N,N,N',N'-tetramethylene-phosphonic acid, and hydrolyzates of maleic anhydride polymers as described in EP-A-345172. Further, it is preferred that washing water and the stabilizing solution contain preservatives which can be incorporated into the fixing solutions and the bleaching-fixing solutions.

Examples of the stabilizing solution which can be used in the stabilization step include processing solutions for stabilizing a dye image, such as organic acids, solutions having an ability of buffering to a pH of from 3 to 6, and solutions containing an aldehyde (e.g., formalin or glutaraldehyde). The stabilizing solution can contain all of the compounds which can be added to washing water. If desired, the stabilizing solution may optionally contain ammonium compounds such as ammonium chloride and ammonium sulfite, compounds of metals such as Bi and Al, fluorescent brighteners, hardening agent and alkanolamines as described in U.S. Pat. No. 4,786,583.

In the present invention, it is preferred that the stabilizing solution substantially does not contain formaldehyde as the above-described stabilizing agent for the color image. The term "substantially does not contain formaldehyde" means that a total amount of free formaldehyde and a hydrate thereof is 0,003 mol or less per liter of the stabilizing solution.

By using such a stabilizing solution, scattering of a vapor of formaldehyde during the processing can be inhibited. In this case, it is preferred that a substitute compound for formaldehyde is present in the stabilizing solution or a bleaching solution or a prebath (for example, a preparation bath) for the purpose of stabilizing a magenta dye.

Preferred compounds as formaldehyde-substituting compounds include hexamethylenetetramine and a derivative thereof, formaldehyde bisulfite adduct, an N-methylol compound and an azolylmethylamine compound. These preferred compounds also inhibit generation of yellow stains with the lapse of time, in addition of the stabilization of the magenta dye.

Hexamethylenetetramaine and the derivatives thereof which can be used include the compounds described in *Beilsteins Handbuch der Organishen Chemie*, The II Supplement, Vol. 26, pages 200–212, and hexamethylenetetramine is particularly preferred.

A preferred formaldehyde-bisulfite adduct is formaldehyde-sodium bisulfite.

Particularly preferred compounds of the N-methylol compounds include N-methylol compounds of pyrazole and derivatives thereof, N-methylol compounds of triazole and derivatives thereof, and N-methylol compounds of urazol and derivatives thereof.

Specific examples of these N-methylol compounds include 1-hydroxymethylpyrazole, 1-hydroxymethyl-2-methylpyrazole, 1-hydroxymethyl-2,4-dimethylpyrazole, 1-hydroxymethyl- 1,2,4-triazole, and 1-hydroxymethylurazol. Of these compounds, 1-hydroxymethylpyrazole and 1-hydroxymethyl-1,2,4-triazole are particularly preferred.

The above-described methylol compounds can be easily synthesized by reacting an amine compound having no attached methylol group with formaldehyde or paraformaldehyde.

When the above N-methylol compounds are used, it is preferred that an amine compound having no attached methylol group is also present in the processing solution, preferably at a concentration of from 0.2 to 10 molar times the N-methylol compound.

The azolylmethylamine compounds include 1,4-bis(1,2,4-triazol-1-ylmethylpiperazine and 1,4-bis(pyrazol-1-ylmethyl)piperazine, and the use of the azolylmethylamine compound in combination with an azole such as 1,2,4-triazole or pyrazole (as described in JP-A-4-359249) is particularly preferred because of a high image stability and a low formaldehyde vapor pressure.

A preferred amount of the above-described substitute compound for formaldehyde added is from 0,003 to 0.2 mol, preferably from 0.005 to 0.05 mol per liter of the processing solution. Two or more substitute compounds for formaldehyde may be used together in the processing solution.

The stabilizing solution has a pH of from 3 to 9, more preferably from 4 to 7.

The washing step and the stabilizing step are preferably performed by a multi-stage counter-current system, and, as a number of stages, 2 to 4 stages are preferred. The replenishing amount is from 1 to 50 times the amount carried from the prebath per a unit area, preferably from 1 to 30 times and, more preferably, from 1 to 10 times.

The washing and stabilizing steps in the present invention are preferably carried out in the same manner as described in JP-A-3-33847, page 11, lower right column, line 9 to page 12, upper right column, line 19.

Water used in these washing step and the stabilizing step can be a tap water, but the use of deionized water wherein Ca and Mg ion concentrations are reduced to 5 mg/liter by, for example, an ion-exchange resin, and sterilized water by a halogen or ultraviolet ray sterilizing lamp is preferred.

It is also preferred that an amount of waste solutions is reduced by pouring an overflow solution from the washing step or the stabilizing step into a prebath which has an ability of fixing.

In the processings of the present invention, it is preferred to replenish an appropriate amount of water, a replenisher or a processing replenisher in order to correct the concentration by evaporation. The process for supplement of water is not limited to a specific process, but a process comprising providing a monitoring water tank separately from a bleaching tank, measuring an evaporated amount of water in the monitoring water tank, calculating an evaporated amount of water in the bleaching tank from the resulting evaporated amount of water and supplying water to the bleaching tank in proportion to the evaporated amount of water, as described in JP-A-1-254959 and JP-A-1-254960, and a process for correcting the evaporated amount by using a liquid level sensor or an overflow sensor are preferred, as described in JP-A-3-248155, JP-A-3-249644, JP-A-3-249645, JP-A-3-249646 and JP-A-4-14042. Also, water for correcting the evaporated amount in each of the processing solutions may be tap water, but deionized water or the sterilized water which is preferably used in the above-described washing step can be used advantageously.

The present invention is further described in greater detail by the following examples, but the present invention is not limited thereto.

EXAMPLE 1

Preparation of Multi-layer Color Photographic Material

Each of the layers having the following composition was coated to prepare Sample 101 of the multi-layer color photographic material.

Composition of Light-sensitive Layer

The main materials used in each of the layers is classified as follows:

ExC: a cyan coupler

ExM: a magenta coupler

ExY: a yellow coupler
ExS: a sensitizing dye
UV: a ultraviolet ray absorbing agent
HBS: a high boiling point organic solvent
H: a gelatin hardening agent The numeral corresponding to each of the components stands for a coated amount in terms of a $g/m^2$ unit, and, for the silver halide, a coated amount calculated as silver is shown. However, the coated amount of the sensitizing dye is shown in terms of a mol unit per mol of the silver halide in the same layer.

| | |
|---|---|
| First Layer (Anti-halation Layer) | |
| Black Colloidal Silver | 0.18 as Ag |
| Gelation | 1.60 |
| ExM-1 | 0.11 |
| ExF-1 | $3.4 \times 10^{-3}$ |
| ExF-2 (a solid dispersed dye) | 0.03 |
| ExF-3 (a solid dispersed dye) | 0.04 |
| HBS-1 | 0.16 |
| Second Layer (Intermediate Layer) | |
| ExC-2 | 0.055 |
| UV-1 | 0.011 |
| UV-2 | 0.030 |
| UV-3 | 0.053 |
| HBS-1 | 0.05 |
| HBS-2 | 0.02 |
| Polyethyl Acrylate Latex | $8.1 \times 10^{-2}$ |
| Gelatin | 1.75 |
| Third Layer (Low Sensitivity Red-sensitive Emulsion Layer) | |
| Silver Iodobromide Emulsion A | 0.46 as Ag |
| ExS-1 | $5.0 \times 10^{-4}$ |
| ExS-2 | $1.8 \times 10^{-5}$ |
| ExS-3 | $5.0 \times 10^{-4}$ |
| ExC-1 | 0.11 |
| ExC-3 | 0.045 |
| ExC-4 | 0.07 |
| ExC-5 | 0.0050 |
| ExC-7 | 0.001 |
| ExC-8 | 0.010 |
| Cpd-2 | 0.005 |
| HBS-1 | 0.090 |
| Gelatin | 0.87 |
| Fourth Layer (Medium Sensitivity Red-sensitive Emulsion Layer) | |
| Silver Iodobromide Emulsion D | 0.70 as Ag |
| ExS-1 | $3.0 \times 10^{-4}$ |
| ExS-2 | $1.2 \times 10^{-5}$ |
| ExS-3 | $4.0 \times 10^{-4}$ |
| ExC-1 | 0.13 |
| ExC-2 | 0.055 |
| ExC-4 | 0.085 |
| ExC-5 | 0.007 |
| ExC-8 | 0.009 |
| Cpd-2 | 0.036 |
| HBS-1 | 0.11 |
| Gelatin | 0.70 |
| Fifth Layer (High Sensitivity Red-sensitive Emulsion Layer) | |
| Silver Iodobromide Emulsion E | 1.62 as Ag |
| ExS-1 | $2.0 \times 10^{-4}$ |
| ExS-2 | $1.0 \times 10^{-5}$ |
| ExS-3 | $3.0 \times 10^{-4}$ |
| ExC-1 | 0.125 |
| ExC-3 | 0.040 |
| ExC-8 | 0.014 |
| Cpd-2 | 0.050 |
| HBS-1 | 0.22 |
| HBS-2 | 0.10 |
| Gelatin | 1.60 |
| Sixth Layer (Intermedia Layer) | |
| Cpd-1 | 0.07 |
| HBS-1 | 0.04 |
| Polyethyl Acrylate Latex | 0.19 |
| Gelatin | 2.30 |
| Seventh Layer (Low Sensitivity Green-sensitive Emulsion Layer) | |

-continued

| | |
|---|---|
| Silver Iodobromide Emulsion A | 0.24 as Ag |
| Silver Iodobromide Emulsion B | 0.10 as Ag |
| Silver Iodobromide Emulsion C | 0.14 as Ag |
| ExS-4 | $4.0 \times 10^{-5}$ |
| ExS-5 | $1.8 \times 10^{-4}$ |
| ExS-6 | $6.5 \times 10^{-4}$ |
| ExM-1 | 0.005 |
| ExM-2 | 0.30 |
| ExM-3 | 0.09 |
| ExY-1 | 0.015 |
| HBS-1 | 0.26 |
| HBS-3 | 0.006 |
| Gelatin | 0.80 |
| Eighth Layer (Medium Sensitivity Green-sensitive Emulsion Layer) | |
| Silver Iodobromide Emulsion D | 0.94 as Ag |
| ExS-4 | $2.0 \times 10^{-5}$ |
| ExS-5 | $1.4 \times 10^{-4}$ |
| ExS-6 | $5.4 \times 10^{-4}$ |
| ExM-2 | 0.16 |
| ExM-3 | 0.045 |
| ExY-1 | 0.008 |
| ExY-5 | 0.030 |
| HBS-1 | 0.14 |
| HBS-3 | $8.0 \times 10^{-3}$ |
| Gelatin | 0.90 |
| Ninth Layer (High Sensitivity Green-sensitive Emulsion Layer) | |
| Silver Iodobromide Emulsion E | 1.29 as Ag |
| ExS-4 | $3.7 \times 10^{-5}$ |
| ExS-5 | $8.1 \times 10^{-5}$ |
| ExS-6 | $3.2 \times 10^{-4}$ |
| ExC-1 | 0.011 |
| ExM-1 | 0.016 |
| ExM-4 | 0.046 |
| ExM-5 | 0.023 |
| Cpd-3 | 0.050 |
| HBS-1 | 0.20 |
| HBS-2 | 0.08 |
| Polyethyl acrylate Latex | 0.26 |
| Gelatin | 1.57 |
| Tenth Layer (Yellow Filter Layer) | |
| Yellow Colloidal Silver | 0.010 as Ag |
| Cpd-1 | 0.10 |
| ExF-5 (a solid dispersed dye) | 0.06 |
| ExF-6 (a solid dispersed dye) | 0.06 |
| ExF-7 (an oil-soluble dye) | 0.005 |
| HBS-1 | 0.055 |
| Gelatin | 0.70 |
| Eleventh Layer (Low Sensitivity Blue-sensitive Emulsion Layer) | |
| Silver Iodobromide Emulsion A | 0.25 as Ag |
| Silver Iodobromide Emulsion C | 0.25 as Ag |
| Silver Iodobromide Emulsion D | 0.10 as Ag |
| ExS-7 | $8.0 \times 10^{-4}$ |
| ExY-1 | 0.010 |
| ExY-2 | 0.70 |
| ExY-3 | 0.055 |
| ExY-4 | 0.006 |
| ExY-6 | 0.075 |
| ExC-7 | 0.040 |
| HBS-1 | 0.25 |
| Gelatin | 1.60 |
| Twelfth (High Sensitivity Blue-sensitive Emulsion Layer) | |
| Silver Iodobromide Emulsion F | 1.30 as Ag |
| ExS-7 | $3.0 \times 10^{-4}$ |
| ExY-2 | 0.15 |
| ExY-3 | 0.06 |
| HBS-1 | 0.070 |
| Gelatin | 1.13 |
| Thirteenth Layer (First Protective Layer) | |
| LTV- 2 | 0.08 |
| UV-3 | 0.11 |
| LTV- 4 | 0.26 |

-continued

| | |
|---|---|
| HBS-1 | 0.09 |
| Gelatin | 3.70 |
| Fourteenth Layer (Second Protective Layer) | |
| Silver Iodobromide Emulsion G | 0.10 as Ag |
| H-1 | 0.37 |
| B-1 (diameter, 1.7 μm) | $5.0 \times 10^{-2}$ |
| B-2 (diameter, 1.7 μm) | 0.10 |
| B-3 | 0.10 |
| S-1 | 0.20 |
| Gelatin | 1.75 |

Further, in order to improve the preservability, processability, pressure resistance, antifungal and antibacterial properties, antistatic property and coating property of the material, W-1 to W-3, B-4 to B-6, F-1 to F-17, an iron salt, a lead salt, a gold salt, a platinum salt, an iridium salt, a palladium salt and a rhodium salt were appropriately incorporated into various layers.

TABLE 1

| Emulsion | Average AgI Content (%) | Average Grain Diameter (μm) | Coefficient of Variation of Grain Diameter (%) | Proportion of Grains having 2 or more of Diameter/Thickness Ratio (%) | Grain Structure/Shape |
|---|---|---|---|---|---|
| A | 2.1 | 0.55 | 25 | 81 | Uniform/Tabular |
| B | 9.1 | 0.63 | 26 | 84 | Triple/Tabular |
| C | 3.1 | 0.60 | 24 | 98 | Triple/Tabular |
| D | 4.2 | 0.80 | 19 | 92 | Triple/Tabular |
| E | 3.2 | 1.10 | 17 | 96 | Triple/Tabular |
| F | 10.8 | 1.75 | 27 | 60 | Double/Tabular |
| G | 1 | 0.07 | 15 | 0 | Uniform/Cubic |

(1) Emulsions A to F were subjected to reduction sensitization with thiourea dioxide and thiosulfonic acid during the preparation of grains in accordance with an example described in JP-A-2-191938;

(2) Emulsions A to F were subjected to gold sensitization, sulfur sensitization and selenium sensitization in the presence of the spectral sensitizing dye as set forth with reference to the various light-sensitive layers and sodium thiocyanate in accordance with an example described in JP-A-3-237450;

(3) The preparation of tabular grains was conducted with the use of a low molecular weight gelatin in accordance with an example described in JP-A-l-158426; and (4) In the tabular grains, dislocation lines as described in JP-A-3-237450 were observed under a high voltage electron microscope.

(5) Emulsion G was non-sensitized Lippmann emulsion of silver iodobromide grains having iodide content of 1 mol % and having a grain size of 0.07 μm.

Preparation of Dispersion of Organic Solid Dispersed Dye

ExF-2 described below was dispersed in the following method. That is, 21.7 ml of water, 3 ml of a 5% aqueous solution of sodium p-octylphenoxyethoxyethanesulfonate and 0.5 g of a 5% aqueous solution of p-octylphenoxypolyoxyethylene ether (a degree of polymerization, 10) were charged into a 700 ml pot mill, and 5.0 g of dye ExF-2 and 500 ml of zirconium oxide beads (a diameter, 1 mm) were added thereto, followed by dispersing the content in the pot for 2 hours. For the dispersion, BO Type vibration boat mill produced by Chuo Koki Co., Ltd. was used. After dispersion, the content was taken out and added to 8 g of a 12.5% aqueous gelatin solution and the beads were removed by filtration to obtain a gelatin dispersion of the dye. An average particle diameter of the dye fine particles was 0.44 μm.

In the same manner as described above, solid dispersions of ExF-3, ExF-4 and ExF-6 were obtained. The average diameter of the dye fine particles was 0.24 μm, 0.45 μm, and 0.52 μm, respectively. ExF-5 was dispersed by the microprecipitation dispersion method as described in Example 1 of EP-A-549489. The average particle diameter of the resulting dispersion was 0.06 μm.

Preparation of Dispersion of Couplers Used in Third Layer to Fifth Layer and Process for Adding Them A dispersion was prepared in the same manner as that of the coupler emulsified dispersion as disclosed in Example 1 of JP-A-6-102636 and the dispersion was introduced into the photographic material in the same manner as the addition method as disclosed in Example 1 of JP-A-6-102636.

Preparation of Emulsion E

Emulsion E was prepared in the same manner as in JP-A-3-237450.

ExC-1

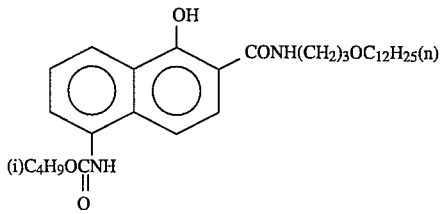

ExC-2

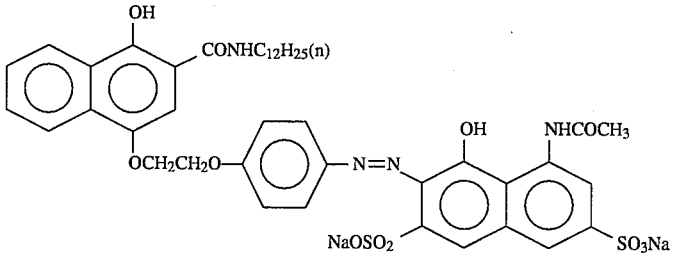

ExC-3

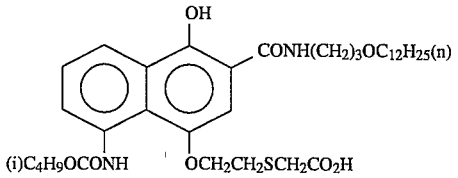

ExC-4

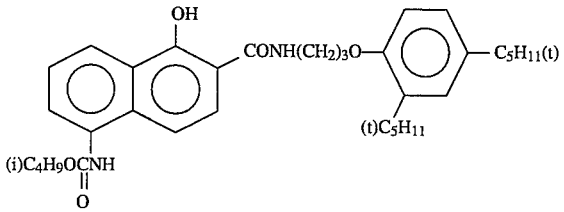

ExC-5

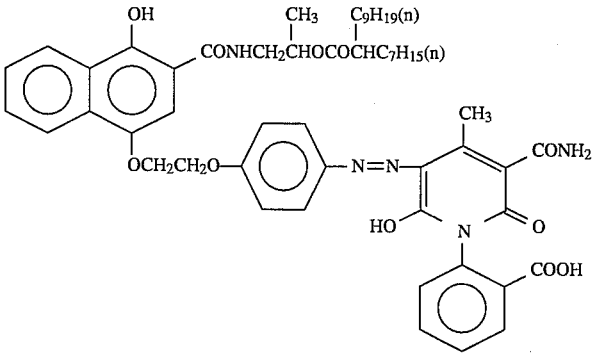

-continued
ExC-7
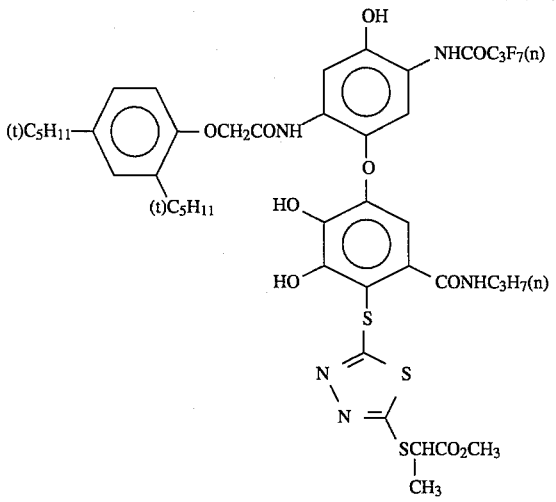
ExC-8
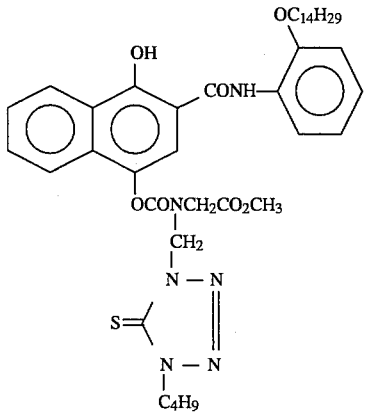
ExM-1
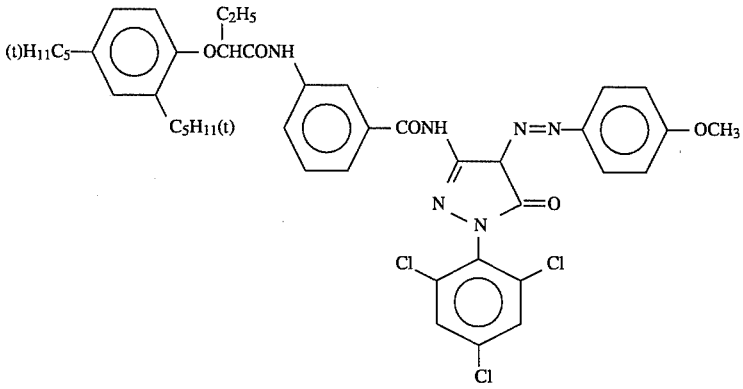

-continued
ExM-2
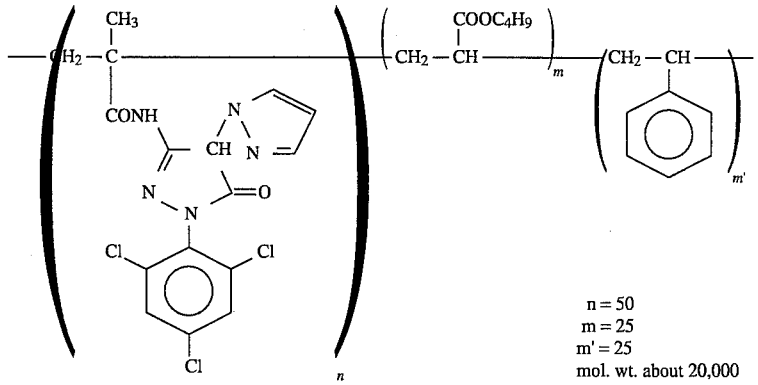
ExM-3
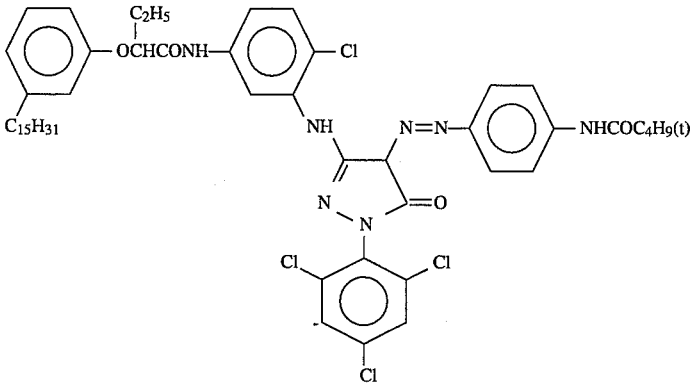
ExM-4
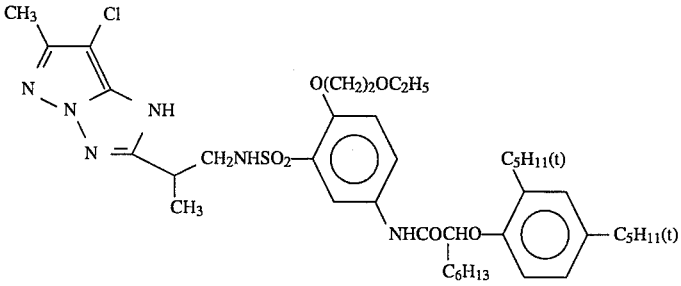
ExM-5
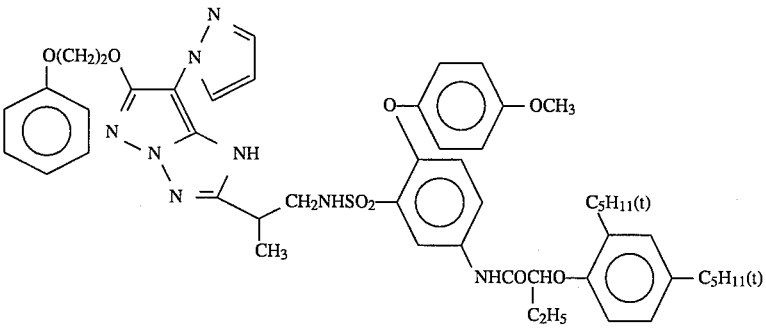

-continued
ExY-1
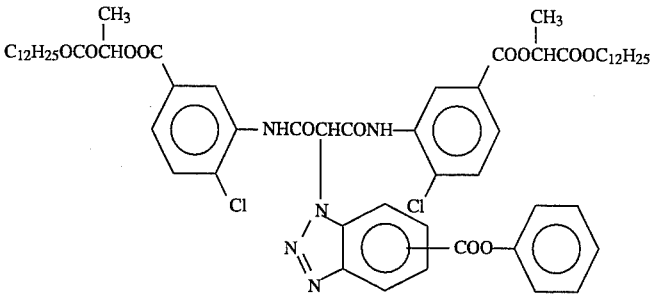
ExY-2
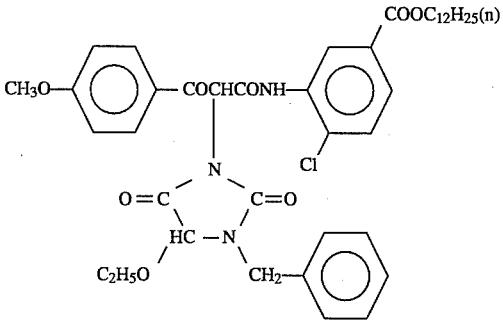
ExY-3
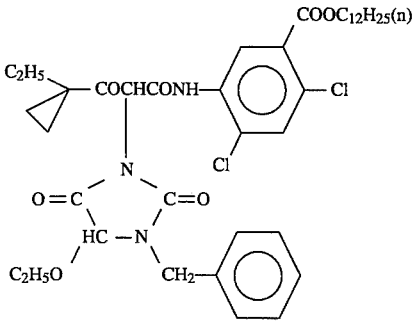
ExY-4
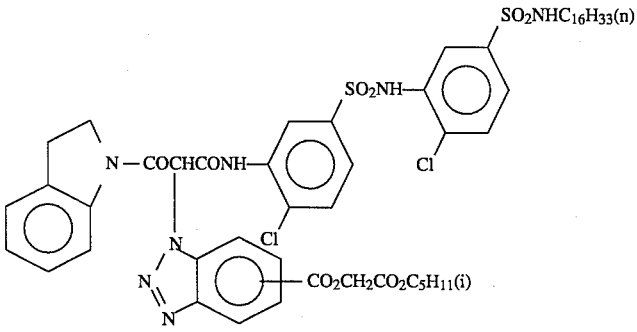
ExY-5
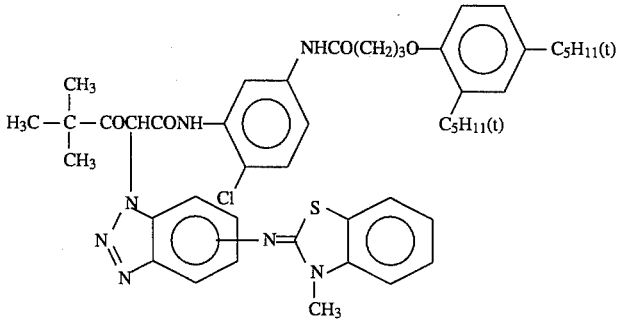

-continued
ExY-6
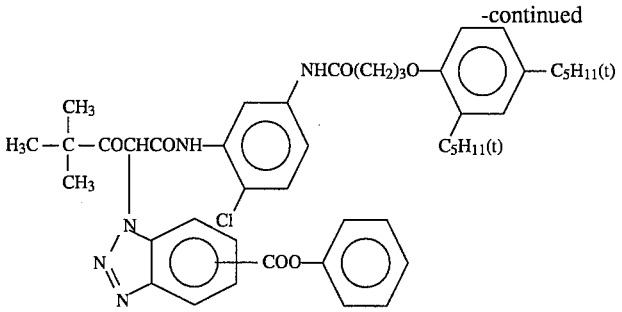
ExF-1
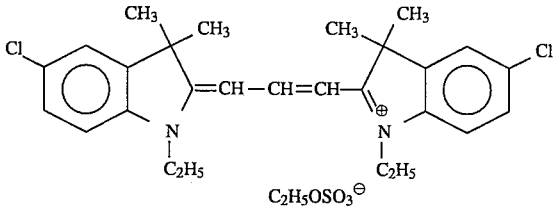
Cpd-1
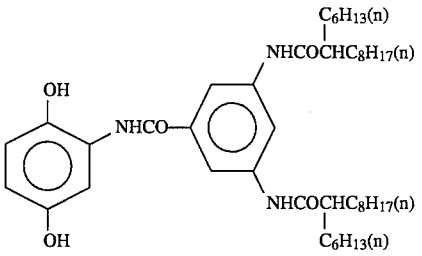
Cpd-2
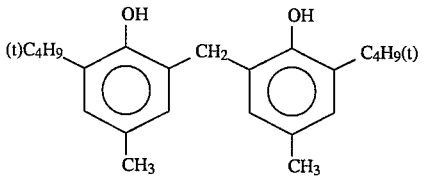
Cpd-3
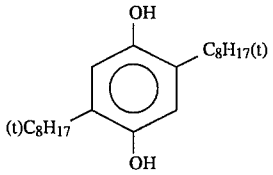
UV-1
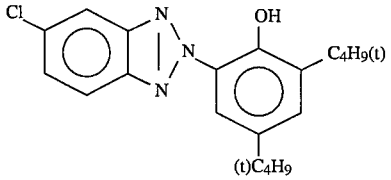
UV-2
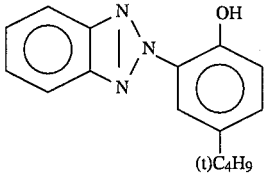

-continued
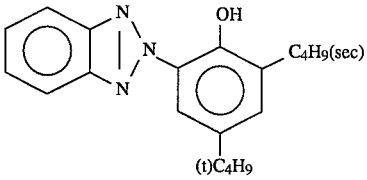
UV-3
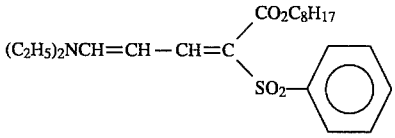
UV-4
Tricresyl phosphate HBS-1
Di-N-butyl phthalate HBS-2
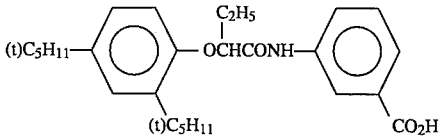
HBS-3
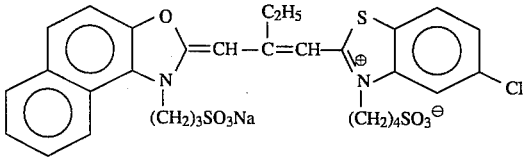
ExS-1
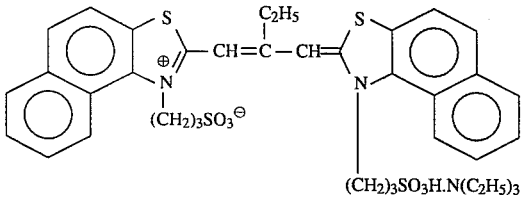
ExS-2
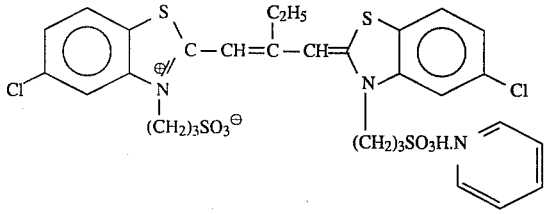
ExS-3
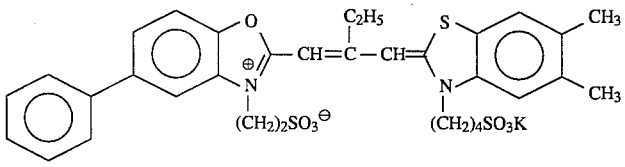
ExS-4
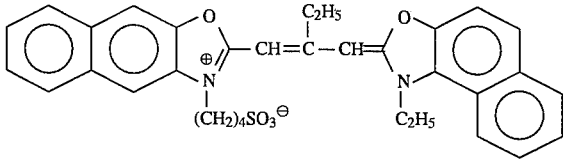
ExS-5

-continued
ExS-6
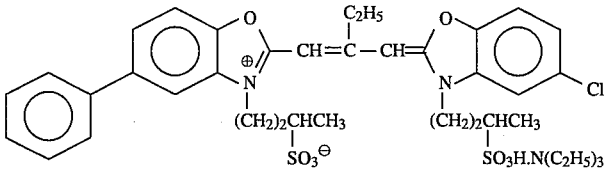
ExS-7
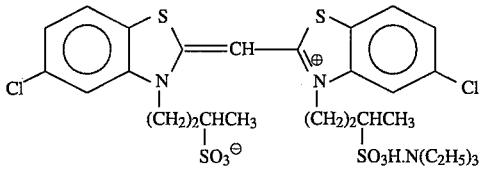
S-1
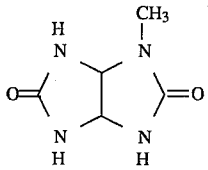
H-1
$CH_2{=}CH-SO_2-CH_2-CONH-CH_2$
$CH_2{=}CH-SO_2-CH_2-CONH-CH_2$
B-1
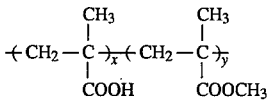
x/y = 10/90
B-2
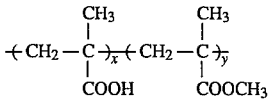
x/y = 40/60
B-3
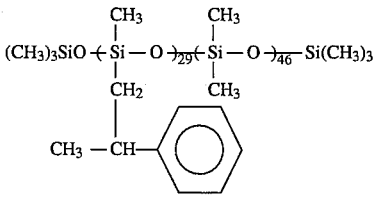
B-4
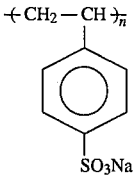
W-1
$C_8F_{17}SO_2NHCH_2CH_2CH_2OCH_2CH_2\overset{\oplus}{N}(CH_3)_3$
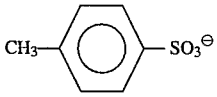
W-2
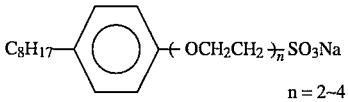
n = 2~4

-continued
W-3
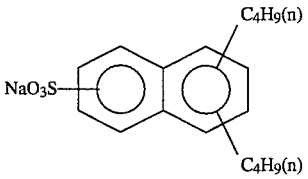
F-1
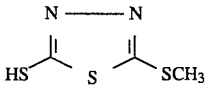
F-2
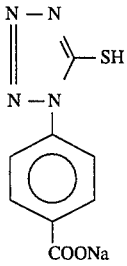
F-3
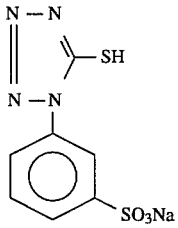
F-4
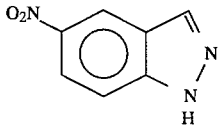
F-5
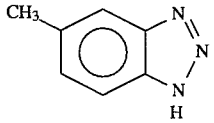
F-6
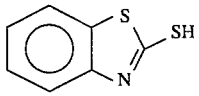
F-7
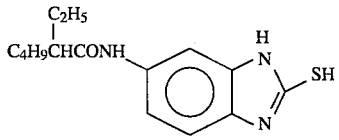
F-8
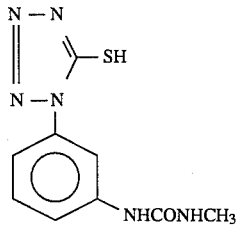
F-9
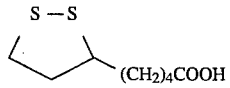

-continued
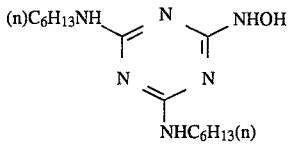
F-10
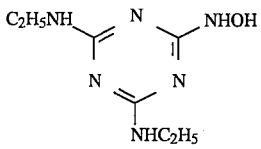
F-11
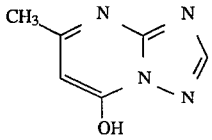
F-12
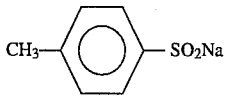
F-13
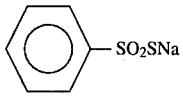
F-14
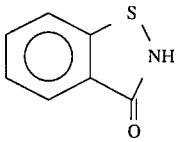
F-15
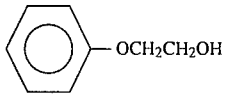
F-16
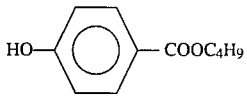
F-17
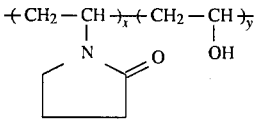
x/y = 70/30
B-5
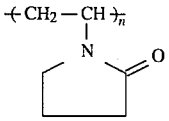
(mol. wt. about 10,000)
B-6
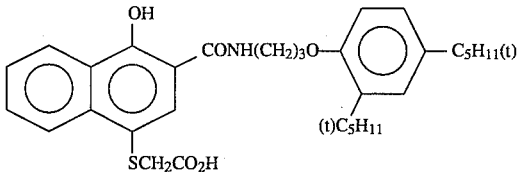
ExC-6

-continued

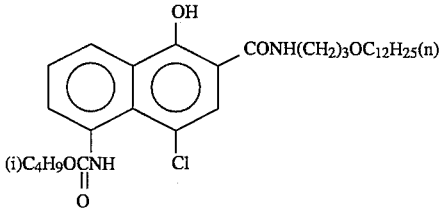

ExC-9

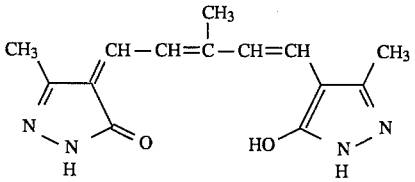

ExF-3

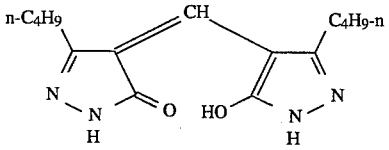

ExF-6

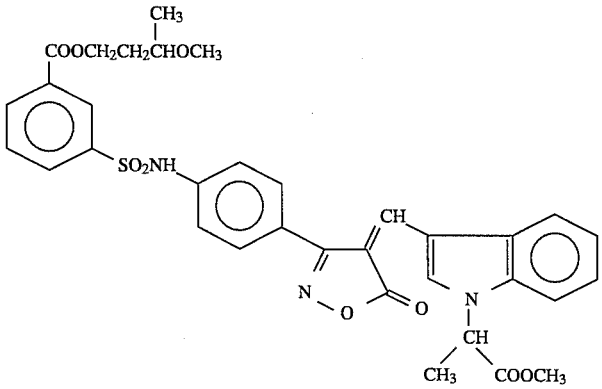

ExF-7

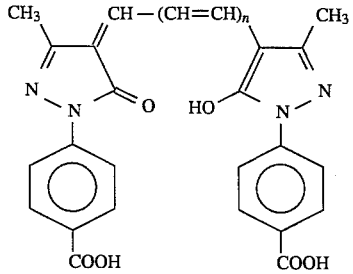

(n = 2) ExF-2
(n = 1) ExF-4
(n = 0) ExF-5

Then, Sample 102 in which Emulsions A to F shown in Table 1 were replaced by Emulsions A-1 to F-1 shown in Table 2, and Sample 103 in which Emulsions A to F shown in Table 1 were replaced by Emulsions A-2 to F-2 shown in Table 3 were prepared. However, in each of the samples, the amount of the sensitizing dye was adjusted in such a manner that the sensitivity became the maximum when exposed for 1/100 second.

TABLE 2

| Emulsion | Average AgI Content (%) | Average Grain Diameter (μm) | Coefficient of Variation of Grain Diameter (%) | Proportion of Grains having 2 or more of Diameter/ Thickness Ratio (%) | Grain Structure/ Shape |
|---|---|---|---|---|---|
| A-1 | 2.1 | 0.39 | 24 | 70 | Uniform/ Tabular |
| B-1 | 9.1 | 0.44 | 23 | 76 | Triple/ Tabular |
| C-1 | 3.1 | 0.43 | 22 | 98 | Triple/ Tabular |
| D-1 | 4.2 | 0.57 | 18 | 86 | Triple/ Tabular |
| E-1 | 3.2 | 0.78 | 16 | 63 | Triple/ Tabular |
| F-1 | 10.8 | 1.35 | 25 | 86 | Double/ Tabular |

TABLE 3

| Emulsion | Average AgI Content (%) | Average Grain Diameter (μm) | Coefficient of Variation of Grain Diameter (%) | Proportion of Grains having 2 or more of Diameter/ Thickness Ratio (%) | Grain Structure/ Shape |
|---|---|---|---|---|---|
| A-2 | 2.1 | 0.31 | 18 | 0 | Uniform/ Octahedron |
| B-2 | 9.1 | 0.36 | 17 | 0 | Triple/ Octahedron |
| C-2 | 3.1 | 0.35 | 19 | 0 | Triple/ Octahedron |
| D-2 | 4.2 | 0.46 | 19 | 0 | Triple/ Octahedron |
| E-2 | 3.2 | 0.63 | 17 | 0 | Triple/ Octahedron |
| F-2 | 10.8 | 1.09 | 16 | 0 | Double/ Octahedron |

Production of Lens-combined Film

Samples 101 to 103 prepared as described above were processed into a 135 format and re-loaded into "Utsurundesu Super 800 FLASH" produced by Fuji Photo Film Co., Ltd. so as to make them in the state ready-to-take photograph.

Photographing

The following photographings were conducted using the above-prepared lens-combined films:

1) A female model with a color rendition chart produced by Macbeth Co., Ltd. was photographed at a daytime in fine weather (an LV value, about 13);
2) A female model with a color rendition chart produced by Macbeth Co., Ltd. was photographed in cloud weather under slightly dark condition (an LV value, about 10); and
3) A female model with a color rendition chart produced by Macbeth Co., Ltd. was photographed in night room using an electronic flash at a photographing distance of 1 m, 3 m, 4 m or 5 m.

Development and Printing

The film after taking photographs was developed by an automatic developing machine for mini-laboratory FP-560B produced by Fuji Photo Film Co., Ltd.

Then, prints in an L size were prepared by a printer-processor for mini-laboratory PP-1250 (a pet name, "Rocky") produced by Fuji Photo Film Co., Ltd.

Evaluation of Prints

The L size prints produced as described above were evaluated for the picture quality in dark portion and the graininess, and the results obtained are shown below.

| Sample | Specific Photographic Sensitivity | Picture Quality in Dark Portion | Graininess | Total Evaluation |
|---|---|---|---|---|
| 101 | 800 | Very Satis-factory | Satisfac-tory | Very Satis-factory |
| 102 | 400 | Satisfac-tory | Satisfac-tory | Satisfac-tory |
| 103 | 100 | Unsatis- | Satisfac- | Unsatis- |

-continued

| Sample | Specific Photographic Sensitivity | Picture Quality in Dark Portion | Graininess | Total Evaluation |
|---|---|---|---|---|
| | | factory | tory | factory |

From the above results, it is understood that a specific photographic sensitivity of 320 or more is preferred in the case of using a lens of an F value on the order of that used in the lens-combined film (the F value=10).

Then, Samples 104 to 129 shown in Table 5 were prepared in the same manner as Sample 101, except for changing Emulsion E in the fifth layer to those shown in Table 4, changing the amount of the gelatin hardening agent H-1 in the fifteenth layer, substituting ExC-1 and ExC-4 in the third layer to the fifth layer by an equimolar amount of ExC-9, and delicately controlling the coating amount.

TABLE 4

| Emulsion | Average AgI Content (%) | Average Grain Diameter (μm) | Coefficient of Variation of Grain Diameter (%) | Proportion of Grains having 2 or more of Diameter/Thickness Ratio (%) | Grain Structure/Shape |
|---|---|---|---|---|---|
| H | 3.2 | 1.10 | 17 | 40 | Triple/Tabular |
| I | 3.2 | 1.10 | 17 | 20 | Triple/Tabular |

TABLE 5

| Sample No. | Emulsion in 5th Layer | Swelling Ratio | 2-Equivalent Ratio in Red-Sensitive Layer | Processing A-1 | | | | |
|---|---|---|---|---|---|---|---|---|
| | | | | $\gamma_{AB}$ | $\gamma_{AG}$ | $\gamma_{AR}$ | $\gamma_B/\gamma_G$ | $\gamma_R/\gamma_G$ |
| 101 | E | 2.1 | 23 | 0.70 | 0.70 | 0.70 | 1.00 | 1.00 |
| 104 | E | 2.3 | 23 | 0.73 | 0.72 | 0.76 | 1.02 | 1.05 |
| 105 | E | 2.5 | 23 | 0.78 | 0.74 | 0.81 | 1.05 | 1.09 |
| 106 | H | 2.1 | 23 | 0.70 | 0.70 | 0.72 | 1.00 | 1.03 |
| 107 | H | 2.3 | 23 | 0.73 | 0.72 | 0.75 | 1.02 | 1.04 |
| 108 | H | 2.5 | 23 | 0.78 | 0.74 | 0.79 | 1.05 | 1.07 |
| 109 | I | 2.1 | 23 | 0.70 | 0.70 | 0.70 | 1.00 | 1.00 |
| 110 | I | 2.3 | 23 | 0.73 | 0.72 | 0.76 | 1.02 | 1.05 |
| 111 | I | 2.5 | 23 | 0.78 | 0.74 | 0.81 | 1.05 | 1.09 |
| 112 | E | 2.1 | 65 | 0.71 | 0.70 | 0.71 | 1.01 | 1.02 |
| 113 | E | 2.3 | 65 | 0.74 | 0.72 | 0.77 | 1.03 | 1.07 |
| 114 | E | 2.5 | 65 | 0.78 | 0.74 | 0.79 | 1.06 | 1.11 |
| 115 | H | 2.1 | 65 | 0.71 | 0.70 | 0.71 | 1.01 | 1.01 |
| 116 | H | 2.3 | 65 | 0.74 | 0.72 | 0.76 | 1.03 | 1.06 |
| 117 | H | 2.5 | 65 | 0.79 | 0.74 | 0.81 | 1.06 | 1.10 |
| 118 | I | 2.1 | 65 | 0.71 | 0.70 | 0.71 | 1.01 | 1.01 |
| 119 | I | 2.3 | 65 | 0.74 | 0.72 | 0.76 | 1.03 | 1.06 |
| 120 | I | 2.5 | 65 | 0.79 | 0.74 | 0.81 | 1.06 | 1.10 |
| 121 | E | 2.1 | 80 | 0.71 | 0.70 | 0.71 | 1.01 | 1.02 |
| 122 | E | 2.3 | 80 | 0.74 | 0.72 | 0.77 | 1.03 | 1.07 |
| 123 | E | 2.5 | 80 | 0.79 | 0.74 | 0.82 | 1.06 | 1.11 |
| 124 | H | 2.1 | 80 | 0.71 | 0.70 | 0.74 | 1.01 | 1.06 |
| 125 | H | 2.3 | 80 | 0.74 | 0.72 | 0.84 | 1.03 | 1.16 |
| 126 | H | 2.5 | 80 | 0.79 | 0.74 | 0.89 | 1.06 | 1.21 |
| 127 | I | 2.1 | 80 | 0.71 | 0.70 | 0.78 | 1.01 | 1.11 |
| 128 | I | 2.3 | 80 | 0.74 | 0.72 | 0.87 | 1.03 | 1.21 |
| 129 | I | 2.5 | 80 | 0.79 | 0.74 | 0.93 | 1.06 | 1.26 |

TABLE 5-continued

| Sample No. | Processing B-1 $\gamma_B/\gamma_G$ | Processing B-1 $\gamma_R/\gamma_G$ | Print Evaluation | Remarks |
|---|---|---|---|---|
| 101 | 1.06 | 0.78 | C | Comparative Example |
| 104 | 1.08 | 0.79 | C | Comparative Example |
| 105 | 1.09 | 0.81 | C | Comparative Example |
| 106 | 1.06 | 0.81 | C | Comparative Example |
| 107 | 1.08 | 0.82 | C | Comparative Example |
| 108 | 1.09 | 0.83 | C | Comparative Example |
| 109 | 1.06 | 0.72 | C | Comparative Example |
| 110 | 1.08 | 0.73 | C | Comparative Example |
| 111 | 1.09 | 0.74 | C | Comparative Example |
| 112 | 1.07 | 0.86 | C | Comparative Example |
| 113 | 1.09 | 0.99 | B | Invention |
| 114 | 1.10 | 1.04 | A | Invention |
| 115 | 1.07 | 0.79 | C | Comparative Example |
| 116 | 1.09 | 0.80 | C | Comparative Example |
| 117 | 1.10 | 0.82 | C | Comparative Example |
| 118 | 1.07 | 0.80 | C | Comparative Example |
| 119 | 1.09 | 0.82 | C | Comparative Example |
| 120 | 1.10 | 0.84 | C | Comparative Example |
| 121 | 1.07 | 0.86 | C | Comparative Example |
| 122 | 1.09 | 1.03 | A | Invention |
| 123 | 1.10 | 1.07 | A | Invention |
| 124 | 1.07 | 0.79 | C | Comparative Example |
| 125 | 1.09 | 0.80 | C | Comparative Example |
| 126 | 1.10 | 0.82 | C | Comparative Example |
| 127 | 1.07 | 0.80 | C | Comparative Example |
| 128 | 1.09 | 0.82 | C | Comparative Example |
| 129 | 1.10 | 0.84 | C | Comparative Example |

The symbols in the item of print evaluation have the following means.

C: The gray balance of prints of negative in Processing A and of prints of negative in Processing B are not compatible and outside the acceptable range.

B: The gray balance of prints of negative in Processing A and of prints of negative in Processing B are good.

A: The gray balance of prints of negative in Processing A and of prints of negative in Processing B are very good.

The samples prepared as described above were processed into a 135 format and re-loaded into "Utsurundesu Super 800 FLASH" produced by Fuji Photo Film Co., Ltd. so as to make them in the state ready-to-take photographs.

A female model with a color rendition chart produced by Macbeth Co., Ltd. was photographed with the lens-combined film at a daytime in fine weather (a LV value, about 13).

The film after taking photographs was processed by the following Development Processing A-1 and Development Processing B-1.

Then, prints in an L size were prepared by a printer-processor for mini-laboratory PP-1250 V (a pet name, "Rocky") produced by Fuji Photo Film Co., Ltd.

The prints produced from the negative as described above were evaluated for face colors of the female model and gray in the color rendition chart, and the results obtained are shown below. Form the results shown in Table 5, the effect of the present invention is clearly noted.

(Development Processing A-1)

| Processing Step | Processing Time | Processing Temperature |
|---|---|---|
| Color Development | 3 min. 15 sec. | 38° C. |
| Bleaching | 1 min. 00 sec | 38° C. |
| Bleaching-Fixing | 3 min. 15 sec. | 38° C. |
| Washing (1) | 1 min. 00 sec. | 38° C. |
| Washing (2) | 1 min. 00 sec. | 38° C. |
| Drying | 2 min. 00 sec. | 60° C. |

The compositions of the processing solutions were shown below.

| | Tank Solution (g) |
|---|---|
| Color Developing Solution | |
| Diethylenetriaminepentaacetic acid | 1.0 |
| 1-Hydroxyethylidene-1,1-diphosphonic acid | 2.0 |
| Sodium sulfite | 4.0 |
| Potassium carbonate | 30.0 |

-continued

| | Tank Solution (g) |
|---|---|
| Potassium bromide | 1.4 |
| Potassium iodide | 1.5 mg |
| Hydroxylamine sulfate | 2.4 |
| 4-[N-Ethyl-N-(β-hydroxyethyl)amino]-2-methylaniline sulfate | 4.5 |
| Water to make | 1.0 liter |
| pH (adjusted with potassium hydroxide and sulfuric acid) | 10.05 |
| Bleacing Solution (Common to tank solution and replenisher) (unit, g) | |
| Ammonium ethylenediaminetetraacetato ferrate dehydrate | 120.0 |
| Disodium ethylenediaminetetraacetate | 10.0 |
| Ammonium bromide | 100.0 |
| Ammonium nitrate | 10.0 |
| Bleaching Accelerator $(CH_3)_2N—CH_2—CH_2—S—S—CH_2—CH_2—N(CH_3)_2.2HCl$ | 0.005 mol |
| Aqueous ammonia (27%) | 15.0 ml |
| Water to make | 1.0 liter |
| pH (adjusted with aqueous ammonia and nitric acid) | 6.3 |
| Bleaching-Fixing Solution | |
| Ammonium ethylenediaminetetraacetato ferrate dehydrate | 50.0 |
| Disodium ethylenediaminetetraacetate | 5.0 |
| Sodium sulfite | 12.0 |
| Aqueous solution of ammonium thiosulfate (700 g/liter) | 240.0 ml |
| Aqueous ammonia (27%) | 6.0 ml |
| Water to make | 1.0 liter |
| pH (adjusted with aq. ammonia and acetic acid) | 7.2 |

Washing Solution (common to both tank solution and replenisher)

Tap water was passed through a mixed bed column filled with an H type strongly acidic cation exchange resin (Amberlite IR-120B produced by Rohm & Haas) and an OH type strongly basic anion exchange resin (Amberlite IRA-400 produced by Rohm & Haas) to reduce the calcium and magnesium ion concentrations to 3 mg/liter. To the solution were then added 20 mg/liter of sodium isocyanurate dichloride and 0.15 g/liter of sodium sulfate to obtain a washing solution. The pH range of the solution was from 6.5 to 7.5.

Steps of Development Processing B-1 and Composition of Processing Solution

| Processing Step | Temperature | Time |
|---|---|---|
| Color Development | 45° C. | 60 sec |
| Bleaching-Fixing | 45° C. | 60 sec |
| Washing (1) | 40° C. | 15 sec |
| Washing (2) | 40° C. | 15 sec |
| Washing (3) | 40° C. | 15 sec |
| Stabilizing | 40° C. | 15 sec |
| Drying | 80° C. | 60 sec |

(Washing was conducted in 3 tanks counter-current system from (3) to (1).)

Composition of Solutions

Color Developing Solution

| | Tank Solution (g) |
|---|---|
| Diethylenetriaminepentaacetic acid | 2.0 |

-continued

| | |
|---|---|
| 1-Hydroxyethylidene-1,1-diphosphonic acid | 3.3 |
| Sodium sulfite | 3.9 |
| Potassium carbonate | 37.5 |
| Potassium bromide | 4.0 |
| Potassium iodide | 1.3 mg |
| Hydroxylamine sulfate | 4.0 |
| 2-Methyl-4-[N-ethyl-N-(β-hydroxyethyl)-amino]aniline sulfate | 18.0 |
| Water to make | 1.0 liter |
| pH (adjusted with potassium hydroxide and sulfuric acid) | 10.05 |
| Bleaching-Fixing Solution | |
| | (mol unit) |
| Ethylenediamine-(2-carboxyphenyl)-N,N',N'-triacetic acid | 0.17 |
| Ferric nitrate nonahydrate | 0.15 |
| Ammonium thiosulfate | 1.25 |
| Ammonium sulfite | 0.10 |
| Metacarboxybenzenesulfinic acid | 0.05 |
| Water to make | 1.0 liter |
| pH (adjusted with acetic acid and ammonia) | 5.8 |
| Washing Water | |
| Same composition as that described in Processing A-1 | |

EXAMPLE 2

Then, in Samples 113 and 114 prepared in Example 1, an amount of gelatin coated in the fifth layer to the fourteenth layer was controlled to prepare Samples 130 to 135 as shown in Table 6.

The samples prepared as above were then processed into a 135 format and then re-loaded into "Utsurundesu Super 800 FLASH" produced by Fuji Photo film Co., Ltd. so as to make them in the state ready-to-take photograph.

TABLE 6

| Sample No. | Emulsion in 5th Layer | Swelling Ratio | 2-Equivalent Ratio in Red-Sensitive Layer | Thickness of Layer | Processing A-1 $\gamma_{AB}$ | $\gamma_{AG}$ | $\gamma_{AR}$ | $\gamma_B/\gamma_G$ | $\gamma_R/\gamma_G$ |
|---|---|---|---|---|---|---|---|---|---|
| 113 | E | 2.3 | 65 | 24 | 0.74 | 0.72 | 0.77 | 1.03 | 1.07 |
| 114 | E | 2.5 | 65 | 24 | 0.78 | 0.74 | 0.79 | 1.06 | 1.07 |
| 130 | E | 2.3 | 65 | 21 | 0.74 | 0.72 | 0.77 | 1.03 | 1.07 |
| 131 | E | 2.5 | 65 | 21 | 0.78 | 0.74 | 0.79 | 1.06 | 1.07 |
| 132 | E | 2.3 | 65 | 18 | 0.75 | 0.73 | 0.78 | 1.03 | 1.07 |
| 133 | E | 2.5 | 65 | 18 | 0.79 | 0.75 | 0.80 | 1.06 | 1.07 |
| 134 | E | 2.3 | 65 | 15 | 0.75 | 0.73 | 0.78 | 1.03 | 1.08 |
| 135 | E | 2.5 | 65 | 15 | 0.79 | 0.75 | 0.80 | 1.06 | 1.09 |

| Sample No. | Processing B-1 $\gamma_B/\gamma_G$ | $\gamma_R/\gamma_G$ | Print Evaluation | Remarks |
|---|---|---|---|---|
| 113 | 1.09 | 0.99 | B | Invention |
| 114 | 1.10 | 1.04 | A | Invention |
| 130 | 1.03 | 1.03 | A | Invention |
| 131 | 1.07 | 1.07 | A | Invention |
| 132 | 1.03 | 1.05 | A | Invention |
| 133 | 1.06 | 1.06 | A | Invention |
| 134 | 1.03 | 1.10 | A | Invention |
| 135 | 1.06 | 1.13 | A | Invention |

The symbols in the item of print evaluation have the following means.

C: The gray balance of prints of negative in Processing A and of prints of negative in Processing B are not compatible and outside the acceptable range.

B: The gray balance of prints of negative in Processing A and of prints of negative in Processing B are good.

A: The gray balance of prints of negative in Processing A and of prints of negative in Processing B are very good.

A female model with a color rendition chart produced by Macbeth Co., Ltd. was photographed with the lens-combined film at a daytime in fine weather (a LV value, about 13).

The film after taking photographs was processed by the following Development Processing A-1 and Development Processing B-1.

Then, prints in an L size were prepared by a printer-processor for mini-laboratory PP-1250 V (a pet name, "Rocky") produced by Fuji Photo Film Co., Ltd.

The prints produced from the negative of Development Processing A-1 and Development Processing B-1 described above were evaluated for face colors of the female model and gray in the color rendition chart, and the results obtained are shown in Table 6. Form the results shown in Table 6, the effect of the present invention is clearly noted.

EXAMPLE 3

Samples 101, and 104 to 129 prepared in Example 1 were then processed into a 135 format and then re-leaded in "Utsurundesu Super 800 FLASH" produced by Fuji Photo film Co., Ltd. so as to make them in the state ready-to-take photographs.

A female model carrying a color rendition chart produced by Macbeth Co., Ltd. was photographed with lens-combined film prepared in the same manner as in Example 1 at a daytime in fine weather (a LV value, about 13).

The film after taking photographs was processed by the following Development Processing A-2 and Development Processing B-2.

The evaluations were performed in the same manner as described in Example 1 and similar results to those of Example 1 were obtained whereby the effect of the present invention was confirmed.

Processing Step and Liquid Composition of Development Processing A-2

| Step | Processing Time | Processing Temperature | Replenishing Amount* | Tank Volume (liter) |
|---|---|---|---|---|
| Color Development | 3 min. 5 sec. | 38.0° C. | 23 ml | 17 |
| Bleaching | 50 sec. | 38.0° C. | 5 ml | 5 |
| Bleaching-Fixing | 50 sec. | 38.0° C. | — | 5 |
| Fixing | 50 sec. | 38.0° C. | 16 ml | 5 |
| Washing | 30 sec. | 38.0° C. | 34 ml | 3.5 |
| Stabilizing (1) | 20 sec. | 38.0° C. | — | 3 |
| Stabilizing (2) | 20 sec. | 38.0° C. | 20 ml | 3 |
| Drying | 1 min. 30 sec. | 60° C. | | |

*The replenishing amount was indicated per 1.1 meter of the light-sensitive material having a width of 35 mm (corresponding to 1 patrone film of 24 exposures).

The flow of the stabilizing solution was a counter-current system of from (2) to (1), and all of the overflow solution of washing water was introduced into a fixing bath. The bleaching-fixing bath was replenished in such a manner that the upper part of each of the bleaching tank and the fixing tank of the automatic development machine was provided with a slit, and all of overflow solution caused by supplying the replenishers to the bleaching tank and the fixing tank was allowed to flow into the bleaching-fixing bath. The amount of the developing solution brought into the bleaching step, the amount of the bleaching solution brought into the bleaching-fixing step, the amount of the bleaching-fixing solution brought into the fixing step and the amount of the fixing solution brought into the washing step were 2.5 ml, 2.0 ml, 2.0 ml and 2.0 ml, respectively, per 1.1 meter of the light-sensitive material having a width of 35 mm. The cross-over time in each step was 6 seconds and was included in the processing time of each of the preceding steps.

The compositions of the processing solutions were shown below.

| Color Developing Solution | Tank Solution (a) | Replenisher (g) |
|---|---|---|
| Diethylenetriamine-pentaacetic acid | 2.0 | 2.0 |
| 1-Hydroxyethylidene-1,1-diphosphonic acid | 2.0 | 2.0 |
| Sodium sulfite | 3.9 | 5.1 |
| Potassium carbonate | 37.5 | 39.0 |
| Potassium bromide | 1.4 | 0.4 |
| Potassium iodide | 1.3 mg | — |
| Hydroxylamine sulfate | 2.4 | 3.3 |
| 2-Methyl-4-[N-ethyl-N-(β-hydroxyethyl)amino]-aniline sulfate | 4.5 | 6.0 |
| Water to make | 1.0 liter | 1.0 liter |
| pH (adjusted with potassium hydroxide and sulfuric acid) | 10.05 | 10.15 |
| Bleaching Solution | | |
| Ammonium 1,3-diaminopropane-tetraacetato ferrate monohydrate | 130 | 195 |
| Ammonium bromide | 70 | 105 |
| Ammonium nitrate | 14 | 21 |
| Hydroxyacetic acid | 50 | 75 |
| Acetic acid | 40 | 60 |
| Water to make | 1.0 liter | 1.0 liter |
| pH (adjusted with aqueous ammonia) | 4.4 | 4.4 |

Bleaching-fixing Tank Solution

A mixture of the above-described bleaching tank solution and the following fixing tank solution at 15 to 85 ratio (by volume). (pH: 7.0).

| Fixing Solution | Tank Solution (g) | Replenisher (g) |
|---|---|---|
| Ammonium sulfite | 19 | 57 |
| Aqueous solution of ammonium thiosulfate (700 g/liter) | 280 ml | 840 ml |
| Imidazole | 15 | 45 |
| Ethylenediamine-tetraacetic acid | 15 | 45 |
| Water to make | 1.0 liter | 1.0 liter |
| pH (adjusted with aqueous ammonia and acetic acid) | 7.4 | 7.45 |
| Washing water | | |

The same composition as in Example 1 was used.

Stabilizing Solution

The same composition as in Example 1 was used.

Processing Step and Liquid Composition of Development

Processing B-2

Processing Step

| Step | Processing Time | Processing Temperature | Replenishing Amount* | Tank Volume (liter) |
|---|---|---|---|---|
| Color Development | 1 min. 30 sec. | 45.0° C. | 200 ml | 1 |

-continued

| Fixing Solution | | | | |
|---|---|---|---|---|
| Bleaching | 20 sec. | 48.0° C. | 130 ml | 1 |
| Fixing | 40 sec. | 48.0° C. | 100 ml | 1 |
| Washing (1) | 15 sec. | 48.0° C. | — | 1 |
| Washing (2) | 15 sec. | 48.0° C. | — | 1 |
| Washing (3) | 15 sec. | 48.0° C. | 400 ml | 1 |
| Drying | 45 sec. | 80° C. | | |

*The replenishing amount was indicated per 1 $m^2$ of the light-sensitive material.

(The washing was performed from (3) to the fixing in a 4-tank counter-current multi-stage cascade system.)

The compositions of the processing solutions were shown below.

| Color Developing Solution | Tank Solution (g) | Replenisher (g) |
|---|---|---|
| Ethylenetriamine-pentaacetic acid | 2.0 | 4.0 |
| 1-Hydroxyethylidene-1,1-diphosphonic acid | 3.3 | 3.3 |
| Sodium sulfite | 3.9 | 6.5 |
| Potassium carbonate | 37.5 | 39.0 |
| Potassium bromide | 2.7 | — |
| Potassium iodide | 1.3 mg | — |
| Hydroxylamine sulfate | 3.0 | 4.5 |
| 2-Methyl-4-[N-ethyl-N-(β-hydroxyethyl)amino]-aniline sulfate | 8.0 | 24.0 |
| Water to make | 1.0 liter | 1.0 liter |
| pH (adjusted with potassium hydroxide and sulfuric acid) | 10.05 | 10.25 |
| Bleaching Solution | | |
| | Tank Solution (mol) | Replenisher (mol) |
| Ammonium 1,3-diaminopropane-tetraacetato ferrate monohydrate | 0.33 | 0.50 |
| Ferric nitrate nonahydrate | 0.30 | 4.5 |
| Ammonium bromide | 0.80 | 1.20 |
| Ammonium nitrate | 0.20 | 0.30 |
| Acetic acid | 0.67 | 1.0 |
| Water to make | 1.0 liter | 1.0 liter |
| pH (adjusted with aqueous ammonia) | 4.5 | 4.0 |
| Fixing Solution | | |
| | Common to Tank Solution and Replenisher (g) | |
| Ammonium sulfite | 28 | |
| Aqueous solution of ammonium thiosulfate (700 g/liter) | 280 ml | |
| Imidazole | 15 | |
| Ethylenediamine-tetraacetic acid | 15 | |
| Water to make | 1.0 liter | |
| pH (adjusted with aqueous ammonia and acetic acid) | 5.8 | |

Washing water

The same composition as in Example 1 was used.

Stabilizing Solution

The same composition as in Example 1 was used.

EXAMPLE 4

The evaluation was conducted in the same manner as described in Example 1, except that the color developing agent, 2-methyl-4-[N-ethyl-N-(β-hydroxyethylamino] aniline sulfate, used in Example 1 was replaced by D-10, and, as a result, the effect of the present invention similar to that of Example 1 was confirmed.

EXAMPLE 5

The evaluation was conducted in the same manner as described in Example 3, except that the color developing agent, 2-methyl-4-[N-ethyl-N-(β-hydroxyethylamino] aniline sulfate, used in Example 3 was replaced by D-11, and the effect of the present invention similar to that of Example 3 was confirmed.

EXAMPLE 6

The evaluation was conducted in the same manner as described in Example 1, except that the color photographic material Sample 401 (a film thickness of 27 μm) described in Example 4 of JP-A-3-194537 was changed in the same manner as described in Examples 1 and 2 of the present invention to prepare a light-sensitive material according to the present invention, and, as a result, the effect of the present invention similar to that of Example 1 was confirmed.

EXAMPLE 7

Samples 101, 104 to 129 prepared in Example 1 were processed in the form of 135 format, and the same evaluation as in Example 1 was conducted using a single-lens reflex camera (trade name "EOS 630" manufactured by CANON INC.), by which the effect of the present invention was confirmed.

EXAMPLE 8

(1) Preparation of Support

Each support used in this example was prepared according to the following manner. Polyethylene naphthalate (PEN): 100 parts by weight of polyethylene-2,6-naphthalate polymer put on the market and 2 parts by weight of Tinuvin P. 326 (manufactured by Geigy) were dried in the conventional manner and the mixture was molten at a temperature of 300° C. The molten mixture was extruded through a T-die and the extruded sheet was stretched in the machine direction at the stretch ratio of 3.3 at a temperature of 140° C. and then stretched in the transverse direction at the stretch ratio of 3.3 at a temperature of 130° C. The biaxially stretched film was thermally fixed at a temperature of 250° C. for 6 seconds to obtain a film having a thickness of 90 μm. Polyethylene terephthalate (PET): Polyethylene terephthalate polymer put on the market was biaxially stretched in the conventional method, the stretched sheet was thermally fixed to obtain a film having a thickness of 90 μm. Triacethyl cellulose (TAC): Triacethyl cellulose and 15% by weight of a mixed plasticizer of triphenyl phosphate and biphenyl diphenyl phosphate (2/1 by weight) were dissolved in a mixed solvent of 82% by weight of methylene chloride and 8% by weight of methanol to obtain a concentrated solution having a triacetyl cellulose concentration of 13% by weight. The solvent was subjected to solvent casting according to the conventional band method to obtain a film having a thickness of 122 μm. PEN/PET=4/1 (weight ratio): PEN pellets and PET pellets were previously dried at a temperature of 150° C. for 4 hours, the dried pellets were kneaded and extruded by means of a twin-screw extruder set at a temperature of 280° C. to form a strand. The strand was pelletized. From the polyester pellets was formed a film having a thickness of 90 μm in the same manner as that for the above-described PEN.

(2) Coating of Subbing Layer:

Each support was subjected to corona discharge treatment on both surfaces, and the coating liquid described below was coated over one surface to form a subbing layer on a surface the temperature of which was higher during stretching. For the corona discharge treatment, a solid state corona-discharging machine 6KVA Model (manufactured by Pillar) was used, and the 30 cm-wide support was treated at a speed of 20 m/min. From the current and voltage values as read out, the strength treating the support was 0.375 KV.A.min./$m^2$. The discharging frequency for the treatment was 9.6 KHz, and the gap clearance between the electrode and the dielectric roll was 1.6 mm.

| Subbing Layer Composition: | |
|---|---|
| Gelatin | 3 g |
| Distilled water | 250 ml |
| Sodium α-sulfodi-2-ethylhexylsuccinate | 0.05 g |
| Formaldehyde | 0.02 g |

(3) Coating of Backing Layer:

After the subbing layer was coated on one surface of each support, a backing layer having the composition described below was coated on the other surface than the subbing layer-coated surface.

(3-1) Preparation of Dispersion of Fine Conductive Grains (dispersion of tin oxide-antinomy oxide composite):

In 3000 parts of by weight ethanol were dissolved 230 parts by weight of stannic chloride hydrate and 23 parts by weight of antimony trichloride to form a uniform solution. To the solution was added dropwise a 1N sodium hydroxide aqueous solution to adjust to pH 3 to obtain a co-precipitate of colloidal stannic oxide and antimony oxide. The co-precipitate was allowed to stand at 50° C. for 24 hours to obtain a reddish brown colloidal precipitate.

The reddish brown colloidal precipitate was separated by centrifugation. Water was added to the precipitate, followed by centrifugation to remove excess ions. This washing operation was repeated three times to remove excess ions.

In 1500 parts by weight of water was re-dispersed 200 parts by weight of the resulting colloidal precipitate. The dispersion was atomized into a baking furnace heated to 600° C. to obtain bluish fine particles of tin oxide-antimony oxide complex having an average particle size of 0.1 μm. The particles had a specific resistance of 25 Ω.cm.

A mixture of 40 parts by weight of the resulting fine particles and 60 parts by weight of water was adjusted to pH 7.0, roughly dispersed with a stirrer, and finely dispersed with a horizontal sand mill ("Dynomill" manufactured by Willy A. Backofen A. G.) so enough to satisfy a retention time of 30 minutes to prepare a conductive particle dispersion. (3-2) Formation of Backing Layer:

A coating having the following formulation (A) was coated on one side of the support to a dry thickness of 0.3 μm and dried at 115° C. for 60 seconds.

| Formulation (A): | |
|---|---|
| Conductive particle dispersion | 10 parts by weight |
| Gelatin | 1 part by weight |
| Water | 27 parts by weight |
| Methanol | 60 parts by weight |
| Resorcin | 2 parts by weight |
| Polyoxyethylene nonylphenyl ether | 0.01 part by weight |

Then, a coating having the following formulation (B) was further coated thereon to a dry thickness of 1 μm and dried at 115° C. for 3 minutes.

| Formulation (B): | |
|---|---|
| Cellulose triacetate | 1 part by weight |
| Acetone | 70 parts by weight |
| Methanol | 15 parts by weight |
| Dichloromethylene | 10 parts by weight |
| p-Chlorophenol | 4 parts by weight |
| Silica particle (average particle diameter 0.2 μm) | 0.01 part by weight |
| Polysiloxane | 0.005 part by weight |
| Dispersion (average particle diameter : 20 nm) of $C_{15}H_{31}COOC_{40}H_{81}$/ $C_{50}H_{101}O(CH_2CH_2O)_{16}H$ (weight ratio : 8/2) | 0.01 part by weight |

(4) Heat Treatment of Support:

Each support having the subbing layer and backing layer was subjected to heat treatment at a temperature of 110° C. for 48 hours. The heat treatment was effected in such a way that each support was wound around a reel core having a diameter of 30 cm with the subbing layer-coated surface facing outward.

(5) Coating of Photographic Layers and Evaluation

Each support as treated in the manner described above was coated with the same photographic layers as those of Samples 101, 104 to 129 to form a photographic material sample. The photographic material sample was processed in the form of 135 format, and the same evaluation as in Example 1 was conducted using a single-lens reflex camera (trade name "EOS 630" manufactured by CANON INC.), by which the effect of the present invention was confirmed.

While the invention has been described in detail and with reference to specific embodiments thereof, it will be apparent to one skilled in the art that various changes and modifications can be made therein without departing from the spirit and scope thereof.

What is claimed is:

1. A method for forming a color image of a color negative photographic material which comprises subjecting a color negative photographic material to a color development processing, said color negative photographic material comprising a support having provided thereon at least one red-sensitive silver halide emulsion layer, at least one green-sensitive silver halide emulsion layer and at least one blue-sensitive silver halide emulsion layer, having a specific photographic sensitivity of 100 or more and having each of the gradients $\gamma_{AR}$, $\gamma_{AG}$ and $\gamma_{AB}$ of 0.5 to 0.9 after standard color development processing within the range of from 3 minutes to 4 minutes of the color development time, said gradients $\gamma_{AR}$, $\gamma_{AG}$ and $\gamma_{AB}$ each being a gradient of the red-sensitive, green-sensitive and blue-sensitive silver halide emulsion layers, respectively, obtained after conducting the standard color development processing, wherein each of the gradients $\gamma_{BR}$, $\gamma_{BG}$ and $\gamma_{BB}$ after the rapid color development processing within the range of from 30 seconds to 90 seconds of the color development time satisfies the following condition:

$$.9<\gamma_{BR}/\gamma_{BG}<1.2,\ 0.9<\gamma_{BB}/\gamma_{BG}<1.2$$

wherein $\gamma_{BR}$, $\gamma_{BG}$ and $\gamma_{BB}$ each represents a gradient of the red-sensitive, green-sensitive and blue-sensitive silver halide emulsion layers, respectively, obtained after conducting the rapid color development processing.

2. A method for forming a color image as claimed in claim 1, wherein the red-sensitive silver halide emulsion layer having a maximum sensitivity in the color photographic material contains an emulsion in which 50% or more of the total projected area is tabular silver halide grains having an aspect ratio of 2 or more, and the swelling ratio of the light-sensitive layer is 2.3 or more, and the ratio of a 2-equivalent coupler to the coupler in the red-sensitive silver halide emulsion is 50 mol % or more.

3. A method for forming a color image as claimed in claim 2, wherein the total film thickness of the light-sensitive layers is 22 μm or less.

4. A method for forming a color image as claimed in claim 1, wherein the ratio of a concentration of a color developing agent in the color developing solution used in the standard color development processing and a concentration of a color developing agent in the color developing solution used in the rapid color development processing is from 1:1.5 to 1:5.

5. A method for forming a color image as claimed in claim 4, wherein the ratio of a halogen ion concentration in the color developing solution used in the standard color development processing and a halogen ion concentration in the color developing solution used in the rapid color development processing is from 1:1.5 to 1:5.

6. A method for forming a color image as claimed in claim 1, wherein the development temperature of the rapid color development processing is higher than that of the standard color development processing by 2° to 15° C.

7. A method for forming a color image as claimed in claim 1, wherein the standard color development processing is carried out using a color developing solution having a color developing agent concentration of from 10 to 16 mmol/l at a development temperature of 35° to 40° C., and the rapid color development processing is carried out using a color developing solution having a color developing agent concentration of from 18 to 60 mmol/l at a development temperature of 38° to 55° C.

8. A method for forming a color image as claimed in claim 1, wherein the specific photographic sensitivity is from 320 to 3,200.

* * * * *